US009430986B2

(12) United States Patent
Ito et al.

(10) Patent No.: US 9,430,986 B2
(45) Date of Patent: Aug. 30, 2016

(54) COLOR SIGNAL PROCESSING DEVICE

(71) Applicant: GODO KAISHA IP BRIDGE 1, Tokyo (JP)

(72) Inventors: Takeshi Ito, Osaka (JP); Haruo Yamashita, Osaka (JP); Tsuyoshi Hirashima, Osaka (JP)

(73) Assignee: GODO KAISHA IP BRIDGE 1, Tokyo (JP)

( * ) Notice: Subject to any disclaimer, the term of this patent is extended or adjusted under 35 U.S.C. 154(b) by 0 days.

(21) Appl. No.: 13/861,841

(22) Filed: Apr. 12, 2013

(65) Prior Publication Data

US 2013/0222414 A1 Aug. 29, 2013

Related U.S. Application Data

(63) Continuation of application No. PCT/JP2011/005719, filed on Oct. 12, 2011.

(30) Foreign Application Priority Data

Oct. 12, 2010 (JP) ..... 2010-229422
Feb. 7, 2011 (JP) ..... 2011-023613

(51) Int. Cl.
*G09G 5/02* (2006.01)
*G09G 3/36* (2006.01)

(52) U.S. Cl.
CPC ..... *G09G 5/02* (2013.01); *G09G 3/3607* (2013.01); *G09G 2340/06* (2013.01)

(58) Field of Classification Search
CPC .. G09G 5/02; G09G 2340/06; G09G 3/3607; G09G 5/10; G09G 2300/0452; G09G 2360/144; G09G 2330/021; G09G 2320/0626; G09G 2320/0666; G09G 2320/041; G09G 3/3208; G09G 3/2003; G09G 2320/0653; G09G 2320/0276; G09G 5/06; G09G 3/3426; G09G 2320/0238; G09G 2320/0646; G09G 2360/16; G09G 3/3225; G09G 2320/0233; G09G 2330/045; G09G 2300/0465; G09G 2340/16; G09G 2320/029; G09G 2320/23; G06T 5/008; G06T 2207/10024; H04N 1/6077; H04N 9/73; H04N 1/6086; H04N 1/6005
See application file for complete search history.

(56) References Cited

U.S. PATENT DOCUMENTS 5,233,413 A * 8/1993 Fuchsberger ..... H04N 1/6027 358/500
5,497,180 A * 3/1996 Kawakami et al. ..... 347/131

(Continued)

FOREIGN PATENT DOCUMENTS

JP 10-123477 5/1998
JP 2001-147666 5/2001

(Continued)

OTHER PUBLICATIONS

Brown_Fig_3C_1 (from Brown Elliott et al., US PGPUB No. 20090278867 A1), Nov. 12, 2009.*

(Continued)

*Primary Examiner* — Devona Faulk
*Assistant Examiner* — Charles L Beard
(74) *Attorney, Agent, or Firm* — Wenderoth, Lind & Ponack, L.L.P.

(57) ABSTRACT

A color signal processing device for generating image data to be displayed on a display device which represents a color by using at least four primary colors, includes an obtainer that obtains a color signal regarding three primary colors for image data composed of a plurality of pixels, a changer that changes a value of the obtained color signal regarding the three primary colors, and a converter that converts the changed color signal regarding the three primary colors into a color signal regarding four primary colors. When a predetermined region contains a color saturated pixel, the changer makes the value of the color signal of at least one color of the three primary colors smaller, for pixels contained in the predetermined region.

8 Claims, 12 Drawing Sheets

(56) References Cited

U.S. PATENT DOCUMENTS 5,592,190 A * 1/1997 Okada ..... G09G 3/3637 345/101
5,594,558 A * 1/1997 Usami ..... H04N 1/6027 358/518
5,786,906 A * 7/1998 Shishizuka ..... G06T 7/408 358/500
5,929,843 A * 7/1999 Tanioka ..... 345/600
6,040,858 A * 3/2000 Ikeda ..... H04N 5/235 348/242
6,088,137 A * 7/2000 Tomizawa ..... G06K 9/00234 348/E7.077
6,192,149 B1 * 2/2001 Eschbach ..... G06T 5/009 382/162
6,278,434 B1 * 8/2001 Hill et al. ..... 345/660
6,292,228 B1 * 9/2001 Cho ..... G09G 5/00 348/603
6,324,006 B1 * 11/2001 Morgan ..... 359/618
6,445,505 B1 * 9/2002 Morgan ..... 359/618
6,459,419 B1 * 10/2002 Matsubayashi ..... 345/156
6,628,833 B1 * 9/2003 Horie ..... G06T 5/001 348/239
6,633,302 B1 * 10/2003 Ohsawa et al. ..... 345/604
6,738,526 B1 * 5/2004 Betrisey et al. ..... 382/260
6,788,812 B1 * 9/2004 Wilkins ..... G06T 5/008 345/22
7,171,051 B1 * 1/2007 Moreton et al. ..... 382/233
7,277,075 B1 10/2007 Hirano et al.
7,403,332 B2 * 7/2008 Whitehead et al. ..... 359/443
7,573,610 B2 * 8/2009 Um ..... H04N 1/6058 345/603
7,577,280 B2 * 8/2009 Guittet ..... G06T 7/0012 382/128
7,592,996 B2 * 9/2009 Brown Elliott et al. ..... 345/102
7,706,606 B1 * 4/2010 Ruzon ..... H04N 1/40012 382/162
7,728,846 B2 * 6/2010 Higgins et al. ..... 345/600
7,852,535 B2 * 12/2010 Kang ..... H04N 1/6022 345/589
7,884,832 B2 * 2/2011 Alessi et al. ..... 345/589
7,932,883 B2 * 4/2011 Klompenhouwer et al. ... 345/88
7,996,341 B1 * 8/2011 Kueck ..... G06T 11/001 382/165
7,999,826 B2 * 8/2011 Mawatari et al. ..... 345/600
8,094,933 B2 * 1/2012 Cok ..... G09G 3/2003 345/694
8,154,563 B2 * 4/2012 Park et al. ..... 345/602
8,159,498 B2 * 4/2012 Higgins et al. ..... 345/581
8,189,069 B2 * 5/2012 Ogawa ..... H04N 5/23232 348/229.1
8,194,010 B2 * 6/2012 Lee ..... G09G 3/3225 345/690
8,203,572 B2 * 6/2012 Park et al. ..... 345/600
8,223,166 B2 * 7/2012 Brown Elliott ..... G09G 3/2051 345/596
8,232,944 B2 * 7/2012 Takada et al. ..... 345/88
8,264,497 B2 * 9/2012 Higgins et al. ..... 345/581
8,274,525 B2 * 9/2012 Langendijk ..... 345/590
8,314,761 B2 * 11/2012 Takada et al. ..... 345/88
8,384,653 B2 * 2/2013 Kim ..... G09G 3/3406 345/102
8,396,290 B1 * 3/2013 Shah et al. ..... 382/167
8,405,780 B1 * 3/2013 Schaem ..... H04N 9/75 348/576
8,411,022 B2 * 4/2013 Brown Elliott et al. ..... 345/102
8,421,818 B2 * 4/2013 Abe ..... G06T 5/009 345/428
8,427,418 B2 * 4/2013 Cho et al. ..... 345/102
8,477,150 B2 * 7/2013 Inuzuka ..... G09G 3/3611 345/589
8,531,368 B2 * 9/2013 Morisue et al. ..... 345/88
8,537,177 B2 * 9/2013 Bhaskaran et al. ..... 345/600
8,570,341 B1 * 10/2013 Xie ..... H04N 1/6005 345/589
8,599,211 B2 * 12/2013 Hsieh et al. ..... 345/589
8,803,929 B2 * 8/2014 Cok ..... G09G 5/02 345/613
8,879,006 B2 * 11/2014 Shimoda ..... H04N 9/67 345/88
8,884,994 B2 * 11/2014 Brown Elliott ..... G09G 5/02 345/102
9,001,145 B2 * 4/2015 Yoshiyama ..... H04N 1/4092 345/613
9,330,614 B2 * 5/2016 Broughton ..... G09G 3/3607
9,355,603 B2 * 5/2016 Chu Ke ..... G09G 3/3607
9,361,855 B2 * 6/2016 Tjissen ..... G09G 5/02
2002/0067432 A1 * 6/2002 Kondo ..... G01R 23/09 348/576
2003/0001104 A1 * 1/2003 Sendai ..... A61B 1/00009 250/458.1
2003/0020736 A1 * 1/2003 Kimura ..... G09G 5/02 345/690
2003/0214499 A1 * 11/2003 Ohsawa et al. ..... 345/204
2004/0222999 A1 * 11/2004 Choi et al. ..... 345/589
2004/0246267 A1 * 12/2004 Oohara ..... G09G 5/02 345/591
2005/0047657 A1 * 3/2005 Lee ..... G09G 5/02 382/167
2005/0088675 A1 * 4/2005 Nagoshi ..... H04N 1/6013 358/1.9
2005/0105796 A1 * 5/2005 Hong ..... G06T 11/001 382/162
2005/0219274 A1 * 10/2005 Yang et al. ..... 345/690
2005/0225561 A1 * 10/2005 Higgins et al. ..... 345/600
2005/0276471 A1 * 12/2005 Shin et al. ..... 382/162
2005/0285828 A1 * 12/2005 Inoue et al. ..... 345/76
2006/0012608 A1 * 1/2006 Lee et al. ..... 345/591
2006/0039017 A1 * 2/2006 Park ..... G09G 3/3607 358/1.9
2006/0044323 A1 * 3/2006 Ameline ..... G06T 11/001 345/595
2006/0066266 A1 * 3/2006 Li Lim et al. ..... 315/291
2006/0126171 A1 * 6/2006 Whitehead et al. ..... 359/443
2006/0146351 A1 * 7/2006 Lo et al. ..... 358/1.9
2006/0187246 A1 * 8/2006 Miyagi ..... H04N 1/233 347/5
2006/0193513 A1 * 8/2006 Minamino ..... H04N 1/56 382/165
2006/0227383 A1 * 10/2006 Kishida ..... G06T 7/0085 358/3.27
2006/0244686 A1 * 11/2006 Higgins et al. ..... 345/72
2006/0256053 A1 11/2006 Baek
2006/0280360 A1 * 12/2006 Holub ..... G01J 3/02 382/162
2006/0284805 A1 12/2006 Baek
2007/0076260 A1 * 4/2007 Upton ..... 358/3.21
2007/0153019 A1 * 7/2007 Nakasone ..... H04N 1/6075 345/589
2007/0223018 A1 * 9/2007 Lammers ..... H04N 9/67 358/1.9
2007/0229866 A1 * 10/2007 Dai ..... H04N 1/00278 358/1.9
2007/0279372 A1 * 12/2007 Brown Elliott et al. ..... 345/102
2008/0018797 A1 * 1/2008 Hsieh ..... H04N 9/68 348/645
2008/0030518 A1 * 2/2008 Higgins et al. ..... 345/589
2008/0056565 A1 * 3/2008 Minamino ..... G06T 7/408 382/162
2008/0079967 A1 * 4/2008 He ..... H04N 1/642 358/1.9
2008/0084524 A1 * 4/2008 Inuzuka et al. ..... 349/108
2008/0117446 A1 * 5/2008 Fukasawa ..... 358/1.9
2008/0137159 A1 * 6/2008 Lim ..... 358/520
2008/0150863 A1 * 6/2008 Morisue et al. ..... 345/88
2008/0150958 A1 * 6/2008 Higgins ..... 345/591
2008/0186328 A1 * 8/2008 Mawatari et al. ..... 345/604
2008/0198180 A1 8/2008 Langendijk
2008/0252750 A1 * 10/2008 Ogawa ..... H04N 5/23232 348/229.1
2008/0260298 A1 * 10/2008 Kamon ..... H04N 3/155 382/321
2009/0010535 A1 * 1/2009 Koishi ..... G06T 11/001 382/167
2009/0059078 A1 * 3/2009 Kim et al. ..... 348/645

(56) References Cited

U.S. PATENT DOCUMENTS

2009/0085926 A1* 4/2009 Kim et al. ..... 345/604
2009/0086094 A1* 4/2009 Lee ..... 348/453
2009/0092325 A1* 4/2009 Brown Elliott et al. ..... 382/232
2009/0102769 A1 4/2009 Kouno et al.
2009/0160747 A1* 6/2009 Morisue et al. ..... 345/88
2009/0174725 A1* 7/2009 Kim ..... G09G 5/02 345/590
2009/0207182 A1* 8/2009 Takada ..... G09G 3/3406 345/589
2009/0268961 A1* 10/2009 Lu ..... H04N 9/68 382/167
2009/0278867 A1* 11/2009 Brown Elliott ..... G09G 3/3426 345/690
2009/0284540 A1* 11/2009 Higgins et al. ..... 345/581
2009/0304275 A1* 12/2009 Kodavalla ..... G06T 5/009 382/167
2009/0324071 A1* 12/2009 Yang ..... G06T 5/007 382/167
2010/0002104 A1* 1/2010 On ..... G06T 5/007 348/252
2010/0013748 A1* 1/2010 Cok et al. ..... 345/83
2010/0013848 A1* 1/2010 Hekstra et al. ..... 345/589
2010/0020242 A1* 1/2010 Lammers ..... G09G 5/02 348/642
2010/0033494 A1* 2/2010 Klompenhouwer .... G06T 5/004 345/590
2010/0054584 A1* 3/2010 Schadt ..... G06K 9/4652 382/164
2010/0085487 A1* 4/2010 Sarkar ..... H04N 1/6005 348/649
2010/0091044 A1* 4/2010 Tsai ..... 345/690
2010/0128024 A1 5/2010 Bae et al.
2010/0214310 A1* 8/2010 Kuwahara et al. ..... 345/590
2010/0225673 A1* 9/2010 Miller ..... G09G 3/2003 345/690
2010/0259556 A1* 10/2010 Inuzuka ..... 345/604
2010/0260413 A1* 10/2010 Yamazaki ..... G06T 5/009 382/164
2010/0309216 A1* 12/2010 Yamashita et al. ..... 345/589
2011/0013208 A1* 1/2011 Bhaskaran et al. ..... 358/1.9
2011/0018891 A1 1/2011 Peng et al.
2011/0050695 A1* 3/2011 Sullivan et al. ..... 345/426
2011/0069331 A1* 3/2011 Honma ..... H04N 1/465 358/1.9
2011/0085062 A1* 4/2011 Rhodes ..... 348/279
2011/0090362 A1* 4/2011 Yanagita ..... H04N 1/6027 348/222.1
2011/0090369 A1* 4/2011 Yanagita ..... H04N 1/56 348/234
2011/0122277 A1* 5/2011 Eto ..... H04N 5/2353 348/222.1
2011/0128438 A1* 6/2011 Yamashita et al. ..... 348/384.1
2011/0135200 A1* 6/2011 Chen ..... G06T 5/003 382/167
2011/0148910 A1* 6/2011 Botzas et al. ..... 345/600
2011/0149166 A1* 6/2011 Botzas ..... H04N 5/202 348/649
2011/0285738 A1* 11/2011 Hsieh et al. ..... 345/589
2011/0285746 A1* 11/2011 Swic ..... 345/597
2011/0292071 A1* 12/2011 Kwon et al. ..... 345/603
2012/0001947 A1* 1/2012 Chu-Ke et al. ..... 345/690
2012/0119670 A1* 5/2012 Vinkenvleugel et al. .... 315/291
2012/0201453 A1* 8/2012 Furuya ..... H04N 1/6027 382/167
2012/0210229 A1* 8/2012 Bryant ..... H04N 9/73 715/723
2012/0249613 A1* 10/2012 Takada et al. ..... 345/690
2013/0106901 A1* 5/2013 Inada et al. ..... 345/600
2013/0176498 A1* 7/2013 Noutoshi ..... H04N 9/68 348/712
2013/0194199 A1* 8/2013 Lynch ..... G06F 3/0412 345/173
2013/0258203 A1* 10/2013 Atkins ..... G09G 5/02 348/708
2014/0176620 A1* 6/2014 Yano ..... G09G 3/3208 345/690
2014/0285508 A1* 9/2014 Tjissen ..... G09G 5/02 345/589
2015/0070404 A1* 3/2015 Chu Ke ..... G09G 3/3607 345/690
2015/0271363 A1* 9/2015 Okada ..... G06Q 30/04 358/1.9
2016/0094759 A1* 3/2016 Miyanaga ..... H04N 1/648 358/519

FOREIGN PATENT DOCUMENTS

| | | |
|---|---|---|
| JP | 2004-286814 | 10/2004 |
| JP | 2006-317899 | 11/2006 |
| JP | 2009-500654 | 1/2009 |
| JP | 2009-93182 | 4/2009 |
| JP | 2010-122657 | 6/2010 |
| WO | 01/37249 | 5/2001 |
| WO | 2007/004194 | 1/2007 |

OTHER PUBLICATIONS

International Preliminary Report on Patentability issued May 16, 2013 in International (PCT) Application No. PCT/JP2011/005719.
International Search Report issued Nov. 8, 2011 in International (PCT) Application No. PCT/JP2011/005719.

* cited by examiner

HUE IN HSV COLOR SPACE

WEIGHTING OF HUE (INPUT TO FILTER)

$x_{ij}$

| | | |
|---|---|---|
| a | b | c |
| d | e | f |
| g | h | i |

(FILTER COEFFICIENTS)

| | | |
|---|---|---|
| ka | kb | kc |
| kd | ke | kf |
| kg | kh | ki |

COLOR SIGNAL PROCESSING DEVICE

CROSS-REFERENCE TO RELATED APPLICATIONS

This is a continuation application of International application No. PCT/JP2011/005719, with an international filing date of Oct. 12, 2011, which claims priority to Japanese patent applications No. JP 2010-229422 as filed on Oct. 12, 2010 and No. JP 2011-023613 as filed on Feb. 7, 2011, the content of which is incorporated herein by reference.

BACKGROUND

1. Technical Field

The present disclosure relates to a color signal processing device for generating image data which can be displayed on a display device which can represent at least four colors.

2. Related Art

Recently, as the imaging technique has been developed, the display devices which have the fourth primary color point such as the Y primary color point in addition to the R primary color point, the G primary color point, and the B primary color point have been proposed.

For example, the liquid crystal display device disclosed in JP 2001-147666 A adds a white component (W) for improving brightness to a red component (R), a green component (G), and a blue component (B) of an input original image and further converts a ratio of the red component, the green component, and the blue component added with the white component into a ratio of the red component, the green component, and the blue component of the original image to drive the respective pixels RGBW. That configuration enables an RGBW type liquid crystal display device by which chromaticity does not change even in the half-tone expression.

Further, JP 2006-317899 A discloses a driving device for a liquid crystal display device which has a liquid crystal panel with four color sub-pixels, a data driver for supplying video data signals to the respective sub-pixels, a gate driver for supplying scan pulses to the sub-pixels, a data converter for generating gain values by analyzing proportions of achromatic signals and chromatic signals from three color source data input from outside and for converting the three color source data into four color data by using the generated gain values, and a timing controller for controlling the gate driver and the data driver while supplying the four color data from the data converter to the data driver.

There is further provided a liquid crystal projector for providing a high-fidelity reproduced image in which the ratios of the white component and the color components in the original video signal are maintained the same without regard of a difference of the quantities of transmitted light between a panel for brightness and a panel for color (see JP 10-123477 A).

SUMMARY

Meanwhile, one of the purposes of converting the input RGB signal into the RGBW signal is to save power by using the W signal to decrease the backlight quantity.

Under the above described control, however, the amount of backlight is decreased, thus the color gamut which can be represented is also decreased. That is, when the backlight is adjusted to achieve the same white brightness as that of the reference RGB signal in displaying the white color by the RGBW signal (in lighting all of the R signal, the G signal, the B signal, and the W signal), the color reproduction area decreases at the primary color point such as the R primary color point.

That is, the improvement of the efficiency in reproducing the white brightness in the conversion of the RGB signal into the RGBW signal causes the decrease in the relative brightness of the high chroma color, leading a problem of decreasing the color reproducibility.

The present disclosure provides a color signal processing device which improves color reproducibility of a color signal obtained by conversion when an input color signal having three primary color points is converted into a color signal composed of at least four colors for reproducing.

A first color signal processing device according to the present disclosure generates image data to be displayed on a display device which represents a color by using at least four primary colors. The first color signal processing device includes an obtainer that obtains a color signal regarding three primary colors for image data composed of a plurality of pixels, a changer that changes a value of the obtained color signal regarding the three primary colors, and a converter that converts the changed color signal regarding the three primary colors into a color signal regarding four primary colors. When a predetermined region contains a color saturated pixel, the changer makes the value of the color signal of at least one color of the three primary colors smaller, for pixels contained in the predetermined region. The color saturated pixel is a pixel, of which color indicated by the color signal converted by the converter is a color outside of a displayable color gamut of the display device.

A second color signal processing device according to the present disclosure generates image data to be displayed on a display device which represents a color by using at least four primary colors. The second color signal processing device includes an obtainer that obtains a color signal regarding three primary colors for image data composed of a plurality of pixels, a changer that changes a value of the obtained color signal regarding the three primary colors, and a converter that converts the obtained color signal regarding the three primary colors into a color signal regarding four primary colors based on a predetermined conversion characteristic. The changer makes the value of the color signal of at least one primary color of the three primary colors smaller, for pixel contained in a predetermined region based on the conversion characteristic of the converter to prevent a color indicated by the converted color signal from being a color outside of a displayable color gamut of the display device in the predetermined region (feedforward control).

According to the color signal processing devices of the present disclosure, when an input signal regarding three primary colors is converted into a signal regarding four primary colors, saturation of the color represented by the converted color signal can be suppressed although the brightness represented by the color signal decreases. Therefore, the color reproducibility of the input color signal can be improved. In particular, according to the color signal processing device of the present disclosure, gain is decreased not only for a pixel outside of the displayable color gamut but also for pixels around the pixel outside of the displayable color gamut. As a result, the device can decrease the signal level without diversifying the shade between the pixel which is suppressed in color saturation and the pixels around the pixel which is suppressed in color saturation, enabling natural color representation in appearance.

Additional benefits and advantages of the disclosed embodiments will be apparent from the specification and drawings. The benefits and/or advantages may be individually provided by the various embodiments and features of the specification and drawings of disclosure, and need not all be provided in order to obtain one or more of the same.

DETAILED DESCRIPTION OF PREFERRED EMBODIMENTS

Embodiments according to the present disclosure will be described below with reference to the attached drawings.

1. First Embodiment

In a first embodiment, when there is a pixel of which color indicated by a color signal converted from the RGB signal into the RGBW signal is a color outside of a displayable color gamut of a display unit, the brightness of an input image is decreased by decreasing the gain of the RGB signal for the region of the entire image, so that color saturation caused by conversion of the color into a color outside of the displayable color gamut is prevented. In particular, the gain is decreased not only for the pixel which is to be converted into a color outside of the displayable color gamut but also for pixels around the pixel to be converted into a color outside of the displayable color gamut. As a result, the signal level can be decreased without diversifying the color shade between the pixel which is suppressed in color saturation and the pixels around the pixel suppressed in color saturation, so that natural color representation in appearance is achieved.

1.1. Configuration of Liquid Crystal Television

A configuration of a liquid crystal television according to the first embodiment will be described below with reference to a drawing.

Figure 1:
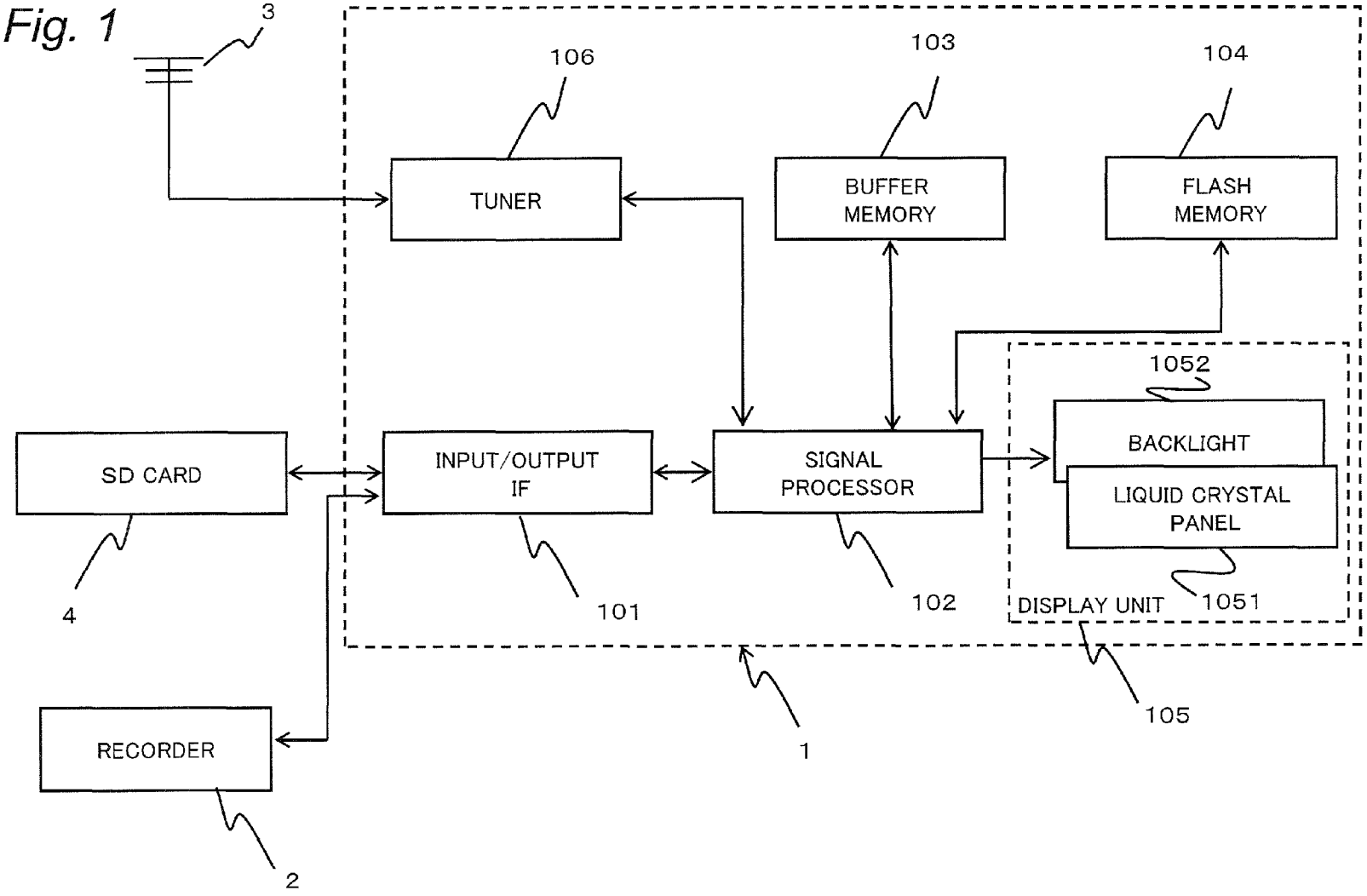
FIG. 1 is a diagram illustrating a configuration of a liquid crystal television according to an embodiment.

FIG. 1 is a diagram illustrating a specific configuration of the liquid crystal television according to the first embodiment. As illustrated in FIG. 1, a liquid crystal television 1 can be connected to a recorder 2, an antenna 3, and an SD card 4. The liquid crystal television 1 obtains a video signal input from the recorder 2, the antenna 3, and the SD card 4, and processes the video signal to display the video signal as video on a display unit of the liquid crystal television 1.

The liquid crystal television 1 has an input/output IF unit 101, a signal processor 102, a buffer memory 103, a flash memory 104, a display unit 105, and a tuner 106.

The input/output IF unit 101 is an interface for allowing the liquid crystal television 1 to be connected to the recorder 2 and the SD card 4. The input/output IF unit 101 enables exchanges of control signals and video signals between the recorder 2 or the SD card 4 and the signal processor 102. Specifically, the input/output IF unit 101 sends a signal received from the recorder 2 or the SD card 4 to the signal processor 102. Also, the input/output IF unit 101 sends a signal received from the signal processor 102 to the recorder 2 or the SD card 4. The input/output IF unit 101 may be implemented with an HDMI connector, an SD card slot, or the like, for example. Alternatively, the input/output IF unit 101 may be configured as a device having a function of the input/output IF unit 101 and a function of the recorder 2. Note that, although FIG. 1 illustrates the input/output IF unit 101 as one block, the input/output IF unit 101 may be configured by a card slot for the SD card 4 and a connector of the recorder 2 for connection. In short, the input/output IF unit 101 may be implemented by any unit as far as the unit implements an interface with an external recording device.

The signal processor 102 controls various components of the liquid crystal television 1. Also, the signal processor 102 may decode a video signal from the input/output IF unit 101. Further, the signal processor 102 performs image processing on the video signal to convert the video signal into a display signal which can be displayed on the display unit 105. The signal processor 102 may be configured by a microcomputer or may be configured by a hardwired circuit. The detailed configuration and operation of the signal processor 102 will be described later.

The buffer memory 103 is used as a work memory for the signal processor 102 to perform signal processing. The buffer memory 103 may be implemented with a DRAM, for example.

The flash memory 104 stores a program to be executed by the signal processor 102, and the like.

The display unit 105 displays a display signal output from the signal processor 102 as a video. The display unit 105 is configured by a liquid crystal panel 1051 and a backlight 1052.

The display unit 105 has a function of displaying an image by modulating a light with the liquid crystal panel 1051, which is emitted by the backlight 1052 from the rear of the liquid crystal panel 1051, according to the display signal input from the signal processor 102. In the present embodiment, the liquid crystal panel 1051 of the display unit 105 is adapted to have a white (W) primary color point in addition to an R primary color point, a G primary color point, and a B primary color point. The configuration with four primary color points of RGBW will be described below for convenience of description. Note that the primary color points are not limited to four colors and the liquid crystal panel 1051 may be adapted to use five or more primary color points. As a primary color point to be added, a yellow primary color point or a cyan primary color point, for example, is possible. Here, the primary color points of the display unit 105 are not limited to the white primary color point in addition to the R primary color point, the G primary color point, and the B primary color point, and may be changed as required according to the intention of a designer or a manufacturer.

The liquid crystal panel 1051 is configured by a liquid crystal layer sandwiched between glass substrates so that a signal voltage is applied by a gate driver (not shown), a source driver (not shown), or the like to the liquid crystal layer corresponding to each pixel to control the transmittance. The gate driver or the source driver provided for the liquid crystal panel 1051 generates a control signal for controlling the transmittance for each pixel based on the transmittance decided in accordance with the image signal.

The liquid crystal panel 1051 uses the IPS (In Plane Switching) scheme. The IPS scheme is advantageous in that the simple movement of the liquid crystal molecules rotating in parallel with the glass substrates achieves a wide viewing angle with little tone variation for the viewing directions and little tone variation throughout the whole gradations. Here, the liquid crystal panel 1051 may be implemented by any device as far as the device performs optical modulation, and may use the VA (Vertical Alignment) scheme, for example, or the like as another scheme of optical modulation.

The backlight 1052 is a device having a function of emitting an irradiation light onto the rear of the liquid crystal panel 1051 for displaying an image. The backlight 1052 adjusts the intensity of the irradiation light based on the display signal input from the signal processor 102. The backlight 1052 may include a semiconductor device for generating the irradiation light such as an LED. Alternatively, the backlight 1052 may include a cold cathode tube for generating the irradiation light.

The tuner 106 is a device for receiving airwaves received by the antenna 3. The tuner 106 sends a video signal of a specific frequency specified by the signal processor 102 to the signal processor 102. As a result, the signal processor 102 can process the video signal of the specific frequency included in the airwaves to cause the video to be displayed on the display unit 105.

1.2. Signal Processor 1.2.1. Configuration of Signal Processor

The specific configuration of the signal processor 102 will be described with reference to a drawing.

In the description below, it is assumed that each pixel of the input video signal includes the RGB signal composed of the R primary color point, the G primary color point, and the B primary color point for convenience of description. Further, the liquid crystal panel 1051 of the display unit 105 has color filters of the R color, the G color, and the B color, and the W color as an expanded color, for each pixel. Here, it is assumed that the W color has the same brightness and the same tint as those of the colors displayed by the additive color mixture of three colors of the R color, the G color, and the B color. Note that the W color is not limited to the above described blend and a bluish W color, for example, may be used.

Figure 2:
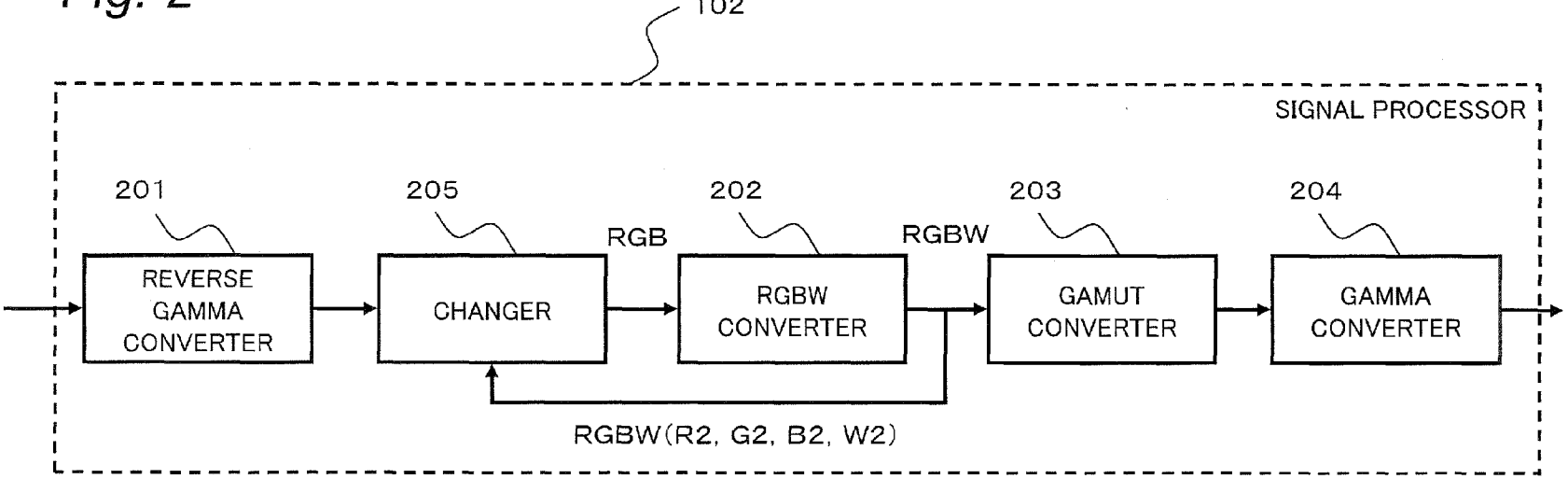
FIG. 2 is a block diagram illustrating a configuration of a signal processor according to a first embodiment.

FIG. 2 is a functional block diagram of the signal processor 102. As illustrated in FIG. 2, the signal processor 102 has a reverse gamma converter 201, an RGBW converter 202, a gamut converter 203, a gamma converter 204, and a changer 205.

The reverse gamma converter 201 performs reverse gamma conversion on the RGB signal input to the signal processor 102, and inputs the converted RGB signal to the changer 205. The reverse gamma conversion performed by the reverse gamma converter 201 is carried out in a generalized method.

The RGBW converter 202 converts the RGB signal output by the changer 205 into the RGBW signal which is composed of the R primary color point, the G primary color point, the B primary color point, and the W primary color point. Further, the RGBW converter 202 outputs the RGBW signal to be obtained by converting the RGB signal to the gamut converter 203 and the changer 205.

The converting operation in the RGBW converter 202 will be described below with reference to drawings.

Figure 3:
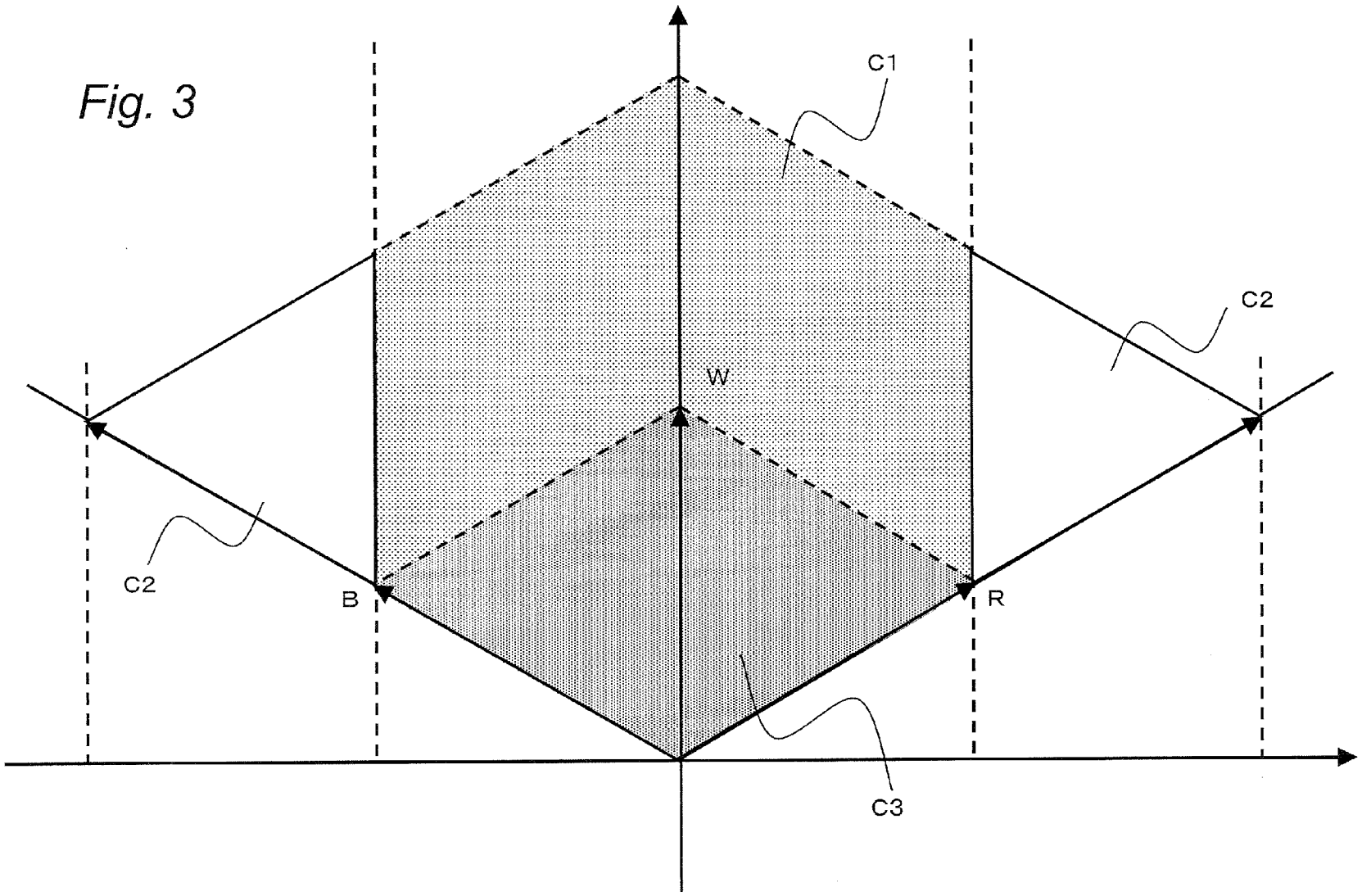
FIG. 3 is a diagram illustrating relation between a color gamut for an input RGB signal and a color gamut for displayed RGBW signal.

FIG. 3 is a diagram illustrating relation between a color gamut for an input RGB signal and a color gamut for an RGBW signal which can be displayed on the display unit 105. Although the color gamut is illustrated only on the R, B, and W signal axes for convenience of description in FIG. 3, the color gamut is a three-dimensional color gamut including the R, G, B, and W signal axes in fact.

It is assumed that the brightness and the chromaticity on the liquid crystal panel 1051 on the condition that the pixels corresponding to the R primary color point, the G primary color point, and the B primary color point are lit at the maximum brightness while the pixels corresponding to the W primary color point are turned off are the same as the brightness and the chromaticity on the liquid crystal panel 1051 on the condition that only the pixels corresponding to the W primary color point are lit at the maximum brightness while the pixels corresponding to the R primary color point, the G primary color point, and the B primary color point are turned off.

The signal processor 102 defines a combined region of a region C1 (a hexagonal region including C3) and regions C2 (triangular regions) on both sides of the region C1 illustrated in FIG. 3 as a color gamut which can be represented by the RGB signal received from the input/output IF unit 101. In that case, since the display unit 105 has the W primary color point in addition to the R primary color point, the G primary color point, and the B primary color point, the color gamut which can be represented only by the R primary color point, the G primary color point, and the B primary color point is expanded. The color gamut is defined like that because addition of the W primary color point becomes meaningless if the color gamut which is represented by the input RGB signal is defined as a region C3 in spite of the addition of the W primary color point. Here, the region C3 is the color gamut which is represented only by using the R, G, B signals on the liquid crystal panel to which the W primary color point is added in addition to the R primary color point, the G primary color point, and the B primary color point.

Here, it is also assumed that the chromaticity value xy meant by the input RGB signal and the chromaticity value xy for the R, G, B pixels which can be displayed on the display unit 105 are the same.

Further, the brightness is different between the input RGB signals Ri, Gi, and Bi and the RGB signals Ro, Go, and Bo displayed on the display unit 1051. Generally, white is displayed as a blend of colors of the respective pixels corresponding to the R primary color point, the G primary color point, and the B primary color point for the input RGB signal. On the other hand, on the display unit 105 according to the present embodiment, white is displayed as a blend of colors of the respective pixels corresponding to the R primary color point, the G primary color point, and the B primary color point and the pixel corresponding to the W primary color point. Therefore, when the brightness of the backlight is set on the basis of the brightness of white color, the brightness displayed on the display unit 105 for the input RGB signal is ½ with respect to the pixels corresponding to the R primary color point, the G primary color point, and the B primary color point. The relation between the input RGB signals Ri, Gi, Bi and the RGBW signals Ro, Go, Bo, Wo which can be displayed on the display unit 1051, based on the above described characteristics, is shown as formulas below.

$$Ro+Go+Bo=Wo \quad \text{[Formula 1]}$$

$$Ro+Go+Bo+Wo=Ri+Gi+Bi \quad \text{[Formula 2]}$$

$$Ro=Ri/2 \quad \text{[Formula 3]}$$

$$Go=Gi/2 \quad \text{[Formula 4]}$$

$$Bo=Bi/2 \quad \text{[Formula 5]}$$

Therefore, with the input RGB signals, the display unit 105 cannot display the colors in the region C2. As described above, in the present embodiment, the brightness on the condition that the pixels corresponding to the R primary color point, the G primary color point, and the B primary color point are lit at the maximum brightness while the pixels corresponding to the W primary color point are turned off is set the same as the brightness on the condition that the pixels corresponding the R primary color point, the G primary color point, and the B primary color point are turned off while the pixels corresponding to the W primary color point are lit at the maximum brightness. As a result, the formula (1) and the formula (2) are established. However, that configuration is not limited thereto, and the brightness on the condition that the pixels corresponding to the R primary color point, the G primary color point, and the B primary color point are lit at the maximum brightness while the pixels corresponding to the W primary color point are turned off and the brightness on the condition that the pixels corresponding to the R primary color point, the G primary color point, and the B primary color point are turned off while the pixels corresponding to the W primary color point are lit at the maximum brightness may be set variably. In that case, the formula (1) and the formula (2) are changed based on the relation among the R primary color point, the G primary color point, the B primary color point, and the W primary color point.

The converting processing of the RGBW converter 202 will be specifically described below.

The RGBW converter 202 converts the input RGB signal into the RGBW signal based on the formula (6) described later by taking account of the characteristics shown by the above formulas (1) to (5).

The RGBW converter 202 doubles the pixel values of the pixels corresponding to the R primary color point, the G primary color point, and the B primary color point which compose the input RGB signal (hereinafter, referred to as "R0", "G0", and "B0", respectively) as shown by the formulas below.

$$R1=R0\times 2$$

$$G1=G0\times 2$$

$$B1=B0\times 2 \quad \text{[Formula 6]}$$

Next, the RGBW converter 202 sets the pixel value of the pixel corresponding to the W primary color point (hereinafter, referred to as "W2") to the minimum value among R1, G1, and B1

$$W2=\min(R1,G1,B1,255) \quad \text{[Formula 7]}$$

Here, the RGBW converter 202 sets the maximum value of W2 at 255. This is because the maximum value of the signal values which can be represented by the display unit 105 is 255. In other word, as the signal value which can be represented on the display unit 105 increases, the maximum value of W2 also increases. Conversely, as the signal value which can be represented on the display unit 105 decreases, the maximum value of W2 also decreases.

Further, the RGBW converter 202 calculates the pixel values of the pixels corresponding to the R primary color point, the G primary color point, and the B primary color point to be output to the display unit 105 (hereinafter, referred to as "R2", "G2", and "B2", respectively) based on R1, G1, B1, and W2.

$$R2=R1-W2$$

$$G2=G1-W2$$

$$B2=B1-W2 \quad \text{[Formula 8]}$$

The RGBW converter 202 outputs the calculated R2, G2, B2 as well as W2 to the display unit 105.

Meanwhile, in the present embodiment, the four color conversion scheme which satisfies the relation of the formulas (1) to (6) is described for simplifying the description. However, the real Wo seldom satisfies the conditions like that. Practically, the brightness and the chromaticity value of Wo differ from those of Ro+Go+Bo in many cases. In addition, Ro, Go, and Bo are not ½ of Ri, Gi, and Bi, respectively, either, in many cases. A publicly known approach such as a balance factor or a matrix operation adjusted for the real Wo color may be used to calculate Ro, Go, Bo, Wo, and the idea of the present disclosure is not limited to the above described four color conversion scheme.

The gamut converter 203 converts the RGBW signal output by the RGBW converter 202 into the RGBW signal within the color gamut which can be displayed by the display unit 1051, and outputs the converted RGBW signal to the gamma converter 204.

Figure 4:
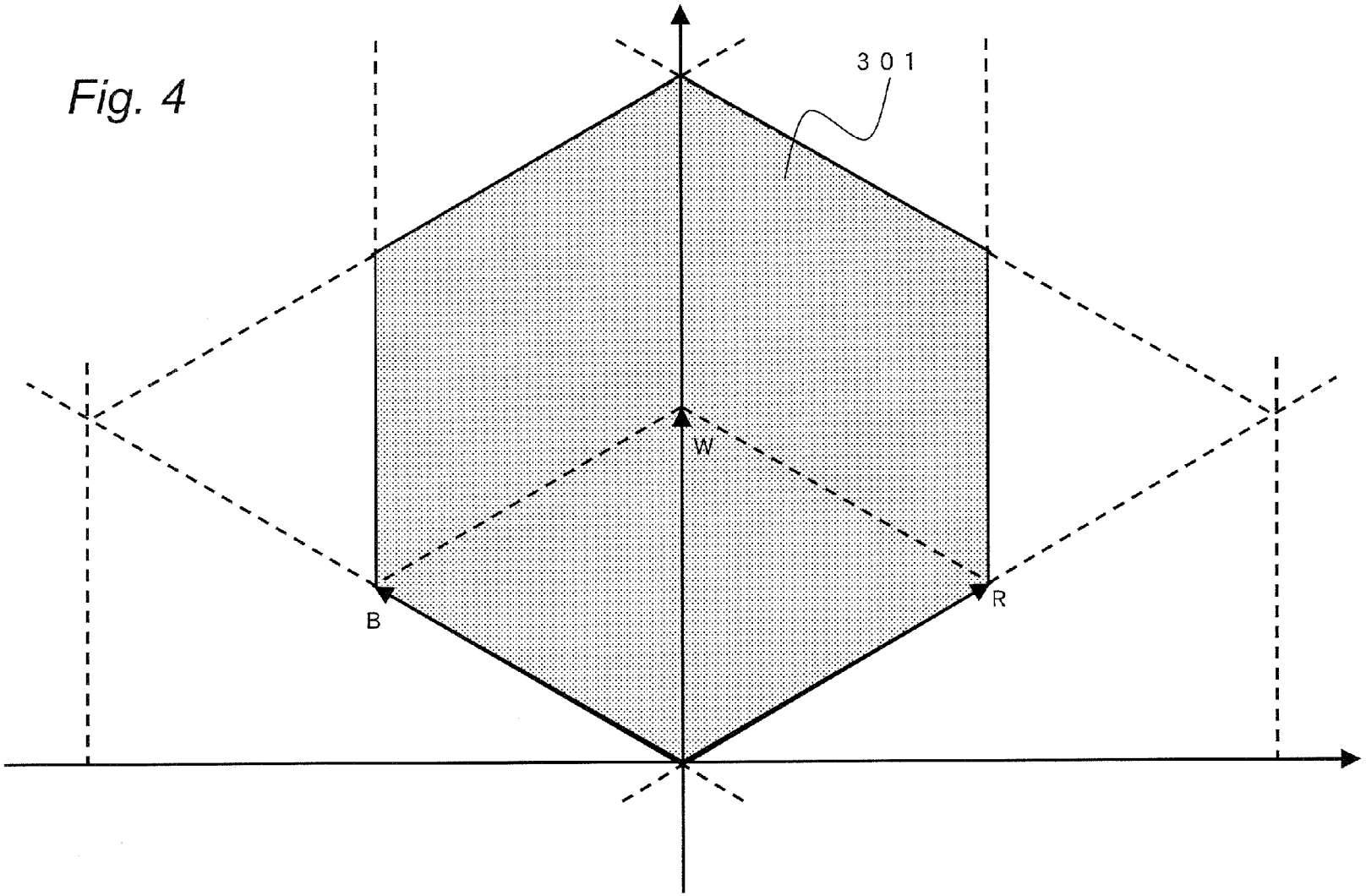
FIG. 4 is a diagram for describing a color compression operation in a gamut converter.

FIG. 4 is a diagram for describing a color compression operation in the gamut converter 203. In FIG. 4, the color gamut 301 is a color gamut for the colors which can be represented by the display unit 105. In other words, the display unit 105 cannot represent the colors contained in the color gamut outside of the color gamut 301.

When the color signal composed of R2, G2, B2, and W2 output from the RGBW converter 202 is placed outside of the region 301, the gamut converter 203 corrects the signal values of R2, G2, B2, and W2 so that the color signal is a color signal within the region 301. Here, a publicly known gamut conversion method may be used as the correction method performed in the gamut converter 203.

The gamma converter 204 performs gamma conversion on the RGBW signal output by the gamut converter 203, and outputs the converted RGBW signal to the display unit 105.

The changer 205 sets gain for the RGB signal received from the reverse gamma converter 201 based on the RGBW signal output by the RGBW converter 202. That is, the changer 205 corrects the gain values of the RGB signal for the image of the current frame based on the RGBW signal from the RGBW converter 202 for the image of the previous frame.

More specifically, the changer 205 detects whether there is a pixel of which color indicated by the RGBW signal obtained by the RGBW converter 202 is a color outside of the color gamut which can be displayed on the display unit 105 (the region 301 illustrated in FIG. 4, hereinafter, referred to as "displayable color gamut"). Hereinafter, a pixel of which color indicated by the RGBW signal obtained by the RGBW converter 202 is a color outside of the displayable color gamut will be also referred to as "color saturated pixel".

When there is a pixel outside of the displayable color gamut (color saturated pixel), the gain values is corrected for the RGB signals for pixels contained in a predetermined region including the color saturated pixel (in the present embodiment, the entire image region) to decrease the gain values. Decreasing the gain values like that decreases the brightness of that pixel to suppress the color saturation of the pixel when the pixel is displayed on the display unit 105. The operation of the changer 205 like that will be described in detail below.

The changer 205 stores a gain factor by which the RGB signal input from the reverse gamma converter 201 is multiplied. The gain factor is set based on the signal values of the pixels composing the picture which is prior to the object of the current processing. Note that, in the beginning of the processing, the changer 205 uses the previously set initial value of the gain factor. For example, the changer 205 stores 1.0 as the initial value of the gain factor.

The changer 205 sets the gain factor based on the RGBW signal output by the RGBW converter 202, and multiplies the signal values of the pixel which compose the input RGB signal by the gain factor. For example, when (R, G, B)=(128, 128, 128) is input as the RGB signal and 0.8 is set as the gain factor, the changer 205 calculates (R, G, B)=(102, 102, 102) as the corrected RGB signal. The calculated RGB signal after the correction is output to the RGBW converter 202. In short, the changer 205 sets the current gain factor based on the signal values composing a picture which was input before in terms of time, and multiplies the signal values of the pixel composing the current picture by the set gain factor.

Here, the changer 205 detects whether there is a pixel of which color indicated by the RGBW signal obtained by the RGBW converter 202 is contained in a region outside of the displayable color gamut 301 (i.e., a color saturated pixel) in a predetermined image region (in the present embodiment, the entire image region). For that purpose, the changer 205 counts the number of pixels which are outside of the displayable color gamut 301.

Specifically, the changer 205 detects whether the RGBW signal composing one pixel which is output by the RGBW converter 202 is in the displayable color gamut 301. When detecting that the RGBW signals are outside of the region 301, the changer 205 counts the number of the pixels. The count value is stored as Cn1. Here, the changer 205 performs the above described processing on the all pixels composing one screen. That is, in the case of an image with 1920×1080 pixels, the changer 205 performs the above described processing by approximately two million times to obtain the count value Cn1.

The changer 205 determines whether the color indicated by the RGBW signal obtained by the RGBW converter 202 needs correction by comparing the count value Cn1 with a first threshold value th1 (an integral number of 1 or more). When determining that the color indicated by the RGBW signal obtained by the RGBW converter 202 needs correction, the changer 205 sets a new gain factor. Here, the first threshold value th1 is previously been set in the changer 205. When the count value Cn1 is the first threshold value th1 or more, the changer 205 determines that the color indicated by the RGBW signal obtained by the RGBW converter 202 needs correction and calculates a gain correction value ΔGd. Here, the gain correction value ΔGd is a correction value for decreasing the currently set value for the gain. This is because decreasing the gain decreases the brightness level of the RGB signal and thus suppresses the color saturation.

Then, the changer 205 sets the result of subtraction of the gain correction value ΔGd from the current gain factor G0 as a new gain factor G0.

$$G0=G0-\Delta Gd \quad \text{[Formula 9]}$$

Here, the case in which the changer 205 calculates the gain correction value ΔGd and subtracts it from the current gain factor is described with the above described configuration. However, that operation is not limited thereto and the changer 205 may calculate the gain correction value ΔGd2 and multiply the current gain factor by the gain correction value ΔGd2 to make the result a new gain factor. That is, the changer 205 may set a new gain factor by the formula below.

$$G0=\Delta Gd2\cdot G0 \quad \text{[Formula 10]}$$

Further, a second threshold value th2 different from the first threshold value th1 is set in the changer 205. The second threshold value th2 is a value smaller than the first threshold value th1. When determining that the count value Cn1 is the second threshold value th2 or less, the changer 205 calculates ΔGu as another gain correction value. Note that the second threshold value th2 may be the same value as the first threshold value th1. In that case, when determining that the count value Cn1 is smaller than the second threshold value th2, the changer 205 calculates ΔGu as another gain correction value.

Then, the changer 205 sets the result of adding ΔGu to the current gain factor G0 as a new gain factor G0. That is, the changer 205 sets a new gain factor by the following formula.

$$G0=G0+\Delta Gu \quad \text{[Formula 11]}$$

Here, the case in which the changer 205 calculates the gain correction value ΔGu and adds it to the current gain factor is described with the above described configuration. However, that configuration is not limited thereto and the changer 205 may calculate the gain correction value ΔGu2 and multiply the current gain factor by the gain correction value ΔGu2 to make the result a new gain factor. That is, the changer 205 sets a new gain factor by the following formula.

$$G0=\Delta Gu2\cdot G0 \quad \text{[Formula 12]}$$

In short, when the count value Cn1 is larger than the first threshold value th1, the changer 205 only needs to correct the gain factor to set a gain factor smaller than the current gain factor. In contrast, when the count value Cn1 is smaller than the second threshold value th2, the changer 205 only needs to correct the gain factor to set a gain factor larger than the current gain factor.

Note that, in setting a new gain factor, the changer 205 sets the new gain factor to vary from the past gain factor (of the last frame) smoothly in terms of time. For example, the changer 205 stores the past gain factor and sets a new gain factor by applying a time axis filter based on the past gain factor.

Meanwhile, the value which does not cause the original signal values to drastically vary (for example, 0.01) may be selected for the gain correction values ΔGd and ΔGu.

1.2.2. Operation of Signal Processor

Figure 5:
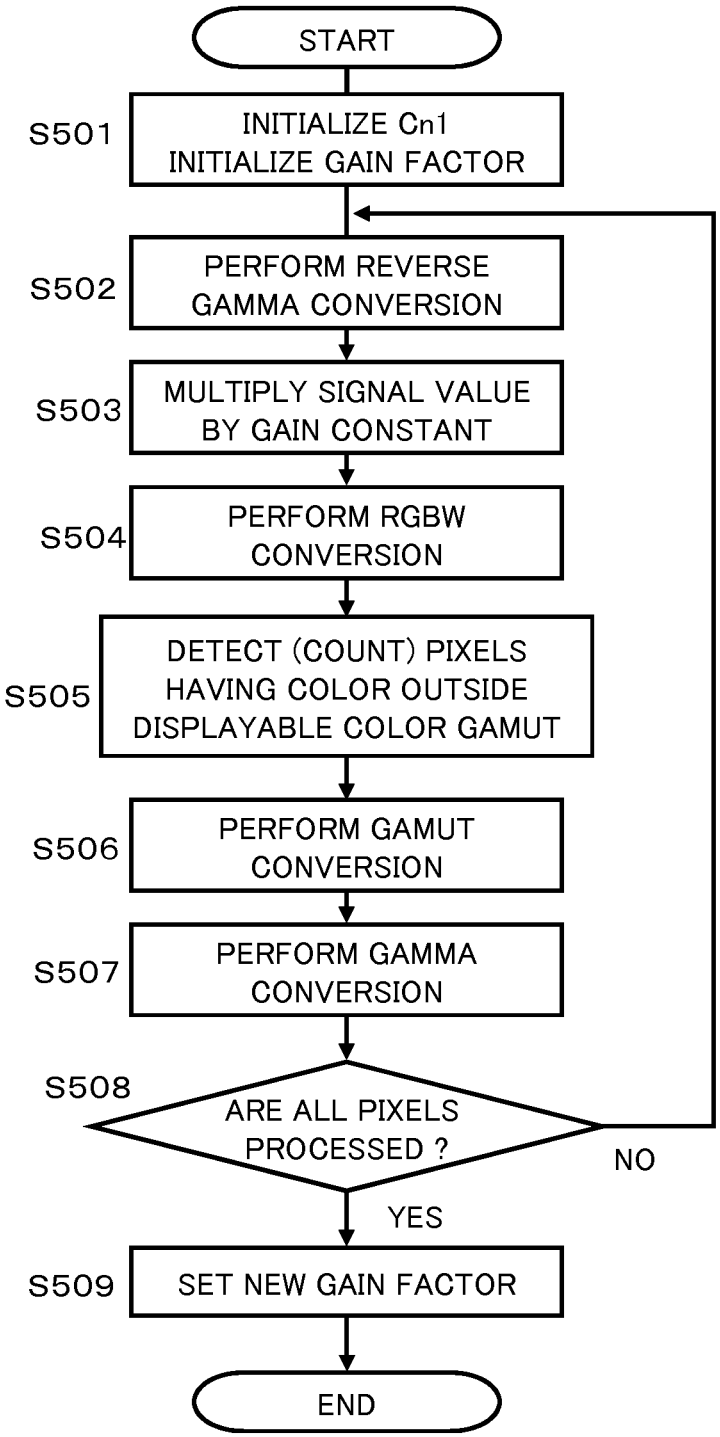
FIG. 5 is a flow chart describing an operation of the signal processor according to the first embodiment.

The signal processing operation of the signal processor 102 will be described below with reference to a drawing. FIG. 5 is a flow chart describing the signal processing operation in the signal processor 102.

For convenience of description, it is assumed below that the RGB signals belonging to one picture are input from the recorder 2 into the input/output IF unit 101 for each picture. Further, it is assumed that the changer 205 performs an operation of detecting whether the RGBW signal composing one pixel which is output by the RGBW converter 202 is in the region 301 illustrated in FIG. 4.

First, when the recorder 2 starts inputting the RGB signal into the reverse gamma converter 201, the changer 205 initializes the count value Cn1 to zero and sets the gain factor to the initial value 1.0 (S501).

When the RGB signal is input through the input/output IF unit 101, the reverse gamma converter 201 performs reverse gamma conversion on the input RGB signal (S502). The reverse gamma converter 201 outputs the RGB signal which is obtained by performing the reverse gamma conversion to the changer 205.

When the RGB signal is input from the reverse gamma converter 201, the changer 205 multiplies the signal values belonging to the pixel of the RGB signal by the gain factor (S503). For example, it is assumed that the gain factor is set at 0.9 and the RGB signal with the respective values of the R signal value, the G signal value, and the B signal value being 200, 100, and 100 are input from the reverse gamma converter 201 to the changer 205. In that case, the changer 205 multiplies the R signal value, the G signal value, the B signal value by the gain factor 0.9 to calculate the R signal value at 180, the G signal value at 90, and the B signal value at 90. The changer 205 outputs the calculation results to the RGBW converter 202.

When the RGB signal is input from the changer 205, the RGBW converter 202 converts the RGB signal into the RGBW signal (S504). The RGBW converter 202 outputs the conversion result to the gamut converter 203 and the changer 205.

When the RGBW signal is input from the RGBW converter 202, the changer 205 detects whether there is a pixel outside of the displayable color gamut 301 based on the RGBW signal which is output by the RGBW converter 202 (S505). When detecting the pixel outside of the displayable color gamut 301, the changer 205 stores the detection result in an internal memory of the changer 205 for each pixel (i.e., counts the pixels which are outside of the region 301).

On the other hand, the gamut converter 203 has the RGBW signal input from the RGBW converter 202 and performs gamut conversion on the RGBW signal (S506). The gamut converter 203 outputs the RGBW signal after the gamut conversion to the gamma converter 204.

When the RGBW signal after the gamut conversion is input from the gamut converter 203, the gamma converter 204 performs gamma conversion on the RGBW signal (S507). The gamma converter 204 outputs the RGBW signal after the gamma conversion to the display unit 105.

The changer 205 determines whether the all RGB signals contained in the input picture are processed (S508). When they are not processed yet, the changer 205 returns to step S302 and continues the processing. On the other hand, when the RGB signals for the all pixels contained in the picture are processed, the changer 205 proceeds to step S509.

The changer 205 corrects the gain factor for the picture in the current frame based on the count value Cn1 of the number of the pixels which are outside of the displayable color gamut 301 stored in the internal memory, and sets the corrected gain factor as new gain factor (S509).

The pictures to be input to the signal processor 102 thereafter will be processed with the new gain factor set in step S509.

1.2.3. Other Examples of Gain Factor Correction

In the above description, the gain factor is set based on the count value of the pixels which are outside of the displayable color gamut 301 (color saturated pixel). However, the setting method of the gain factor is not limited to the processing like that. Examples of other methods of setting the gain factor will be described below.

For example, the changer 205 may detect the "degree" of the signal values of the RGBW signal output by the RGBW converter 202 exceeding the signal values of the colors which can be represented on the liquid crystal panel 1501 and set the gain factor according to the degree. The operation of the changer 205 in that case will be described below.

The changer 205 determines whether the signal values of the RGBW signal which compose one pixel output by the RGBW converter 202 are within the signal values which can be represented on the liquid crystal panel 1501. For example, when the maximum values of the signal values of the RGBW signal values which can be represented on the liquid crystal panel 1501 are (R, G, B, W)=(255, 255, 255, 255), the changer 205 determines whether the signal values of the input RGBW signal are these values or more.

Then, when the signal values of the RGBW signal exceed the signal values of the RGBW signal values which can be represented on the liquid crystal panel 1501, the changer 205 finds differences between the signal values of the input RGB signal and the RGBW signal values which can be represented on the display unit 105 (liquid crystal panel 1501). The changer 205 performs this processing on the all pixels composing one screen. For example, when the picture has the size of 1920×1080 pixels, the above described processing is performed approximately two million times. Then, the changer 205 defines the sum of the differences found for the all pixels composing one picture as the "degree of exceeding the signal values which can be represented (Cn2)".

The changer 205 calculates Cn2 by the following formula, for example. In the formula (13), i is an index indicating a pixel and n corresponds to the number of pixels composing one screen.

$$Cn2 = \sum_{i=1}^{n} \max(R2 - 255, G2 - 255, B2 - 255) \quad \text{[Formula 13]}$$

The formula (13) is for calculating the integrated value Cn2 of the largest values among the differences between the respective signal values of RGB (R2, G2, B2) and 255, the maximum value available for the respective signal values of RGB, as the "degree of exceeding the signal values which can be represented (Cn2)". Meanwhile, the formula (13) is an example of a method of calculating the value meaning the "degree of exceeding the signal values which can be represented" and can be replaced by any other calculation method as far as the method can find the value indicating the degree of exceeding the signal values which can be represented.

The changer 205 corrects the gain factor based on Cn2 obtained by the formula (13). A threshold value th3 is previously set in the changer 205. Here, when determining that Cn2 is th3 or more, the changer 205 calculates ΔGd as a gain correction value.

Then, the changer 205 sets the result of subtracting ΔGd from the current gain factor G0 as new G0. That is, the changer 205 sets a new gain factor by the following formula.

$$G0=G0-\Delta Gd \quad \text{[Formula 14]}$$

In the above example, the configuration with which the changer 205 subtracts the gain correction value ΔGd from the current gain factor is described. However, multiplying the current gain factor by the gain correction value may correct the gain factor. Specifically, the changer 205 may correct the gain factor by calculating the gain correction value ΔGd2 to multiply the current gain factor by the gain correction value ΔGd2. That is, the changer 205 may set a new gain factor by the following formula.

$$G0=\Delta Gd2\cdot G0 \quad \text{[Formula 15]}$$

In short, as far as the changer 205 corrects the gain factor in order to decrease the current gain factor when the degree of exceeding the signal values which can be represented (Cn2) is larger than the threshold value (th3), any method can be used for making the gain correction value to take effect.

The changer 205 may further have a threshold value th4 which is smaller than the threshold value th3 in addition to the threshold value th3. When determining that the degree of exceeding the signal values which can be represented (Cn2) is the threshold value th4 or less, the changer 205 calculates ΔGu as another gain correction value. Note that the threshold value th4 may be the same value as the threshold values th3. In that case, when determining that Cn2 is smaller than th4, the changer 205 calculates ΔGu as another gain correction value.

The changer 205 sets the result of adding ΔGu to the current gain factor G0 as a new gain factor Go. That is, the changer 205 sets a new gain factor by the following formula.

$$G0=G0+\Delta Gu \quad \text{[Formula 16]}$$

Alternatively, the changer 205 may be adapted to calculate the gain correction value ΔGu2, multiply the current gain factor by the gain correction value ΔGu2, and set the result as a new gain factor. That is, the changer 205 may set a new gain factor by the following formula.

$$G0=\Delta Gu2\cdot G0 \quad \text{[Formula 17]}$$

In short, as far as the changer 205 sets the gain factor larger than the current gain factor when the degree of exceeding the maximum values of the signal values which can be represented (Cn2) is smaller than the second threshold value (th4), any method can be used for making the gain correction value to take effect.

Further, in setting a new gain factor, the changer 205 may set the new gain factor to vary from the past gain factor smoothly in terms of time. That is, the changer 205 may be adapted to store the past gain factors and set a new gain factor by applying a time axis filter based on the past gain factor.

Meanwhile, the methods of changing the gain shown in the formulas (9) to (12), (14) to (17) are examples and the method is not limited to them. For example, the addition type which uses the formula (9) has a weakness of responsivity to a large change, and the multiplication type which uses the formula (10) has a problem in convergence after the gain approaches the target value. Therefore, a method of changing the gain with a feature between the addition type which uses the formula (9) and the multiplication type which uses the formula (10) may be adopted. That method will be described below.

For example, in the formulas (9) to (12), (14) to (17), the correction value (ΔGd, ΔGu, or the like) may be changed according to "the number of pixels which have the signal values exceeding the signal values which can be represented (Cn1)" and "the magnitude of the degree of exceeding the signal values which can be represented (Cn2)".

For some hues or levels of the colors, color saturation may not bother the viewer so much, rather, the gain may lower the brightness and may degrade the image quality. For example, saturation sometimes causes yellow to appear unnatural, while the saturation seldom causes green to appear unnatural so much.

Therefore, when the count value of the number of pixels outside of the displayable color gamut 301 (Cn1) or the total value of level differences (Cn2) is to be calculated, the balance between the brightness and the color saturation may be adjusted by the weighting according to the hue. The hue may be specified by using Hue in the HSV color space or may be specified by using the six primary color axes such as RGBCMY. That is, the hue may be represented by any method as far as the counted values are weighted according to the colors.

Figure 6A:
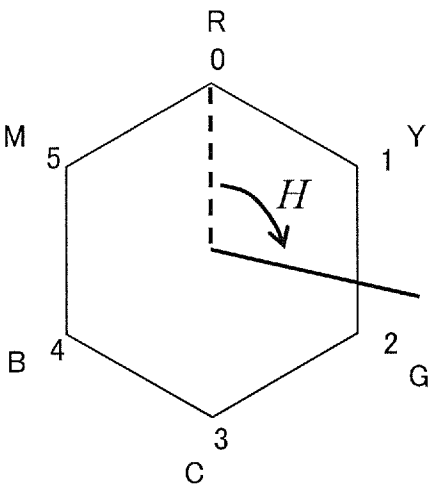
FIG. 6A is a diagram illustrating chromaticity in an HSV space.
Figure 6B:
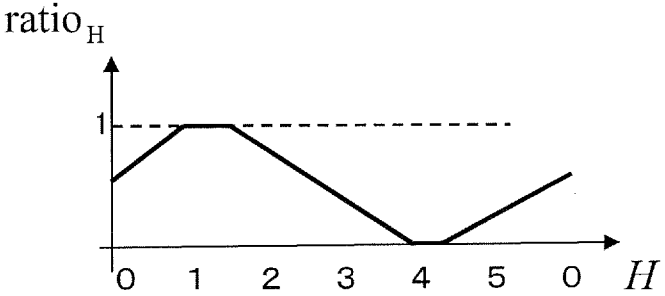
FIG. 6B is a diagram for describing an example of adjustment of balance between brightness and color saturation by using hues.

FIG. 6A and FIG. 6B are diagrams for describing an example of adjustment by using the hues. FIG. 6A is a diagram for describing the hues of the HSV space, which allows simple conversion in the color spaces available for calculating the hue. In FIG. 6A, an angle H indicates an approximate hue. FIG. 6B is a diagram illustrating relation between the hue and the weight ($ratio_H$). In the example of FIG. 6B, the weight ($ratio_H$) for Y (yellow) and its neighboring hues is set larger than the weights for the other hues. As a result, the gain value regarding Y (yellow) and its neighboring hues is set smaller than the gain for the other hues, which makes the colors harder to be saturated. The gain values are set like that because the saturation affects the degrading of image quality more than the decrease of the brightness does with respect to Y (yellow).

The following two formulas are examples of formula for correcting the "degree of exceeding the signal values which can be represented (Cn2)" by using the weight ($ratio_H$) according to the hue illustrated in FIG. 6B. Although typical two formulas are shown below, any other formulas may be used as far as the formula represents the similar tendency.

$$Cn3 = \sum_{i=1}^{n} \min\left(ratio_H, \frac{\max(R2-255, G2-255, B2-255)}{256}\right) \quad \text{[Formula 18]}$$

$$Cn4 = \sum_{i=1}^{n} \left\{ratio_H \times \frac{\max(R2-255, G2-255, B2-255)}{256}\right\} \quad \text{[Formula 19]}$$

Here, the color which has the brightness more significantly decreased when the color is saturated (when the color is outside of the displayable color gamut) tends to appear cloudier than the surrounding colors. Thus, the degrading of image quality may occur such that bright yellow (Y) appears like ocher. The degree is conceived larger for the color which has a higher proportion of contributing to the brightness. The proportions of contributing to the brightness as for RGB are approximately R:G:B=0.3:0.6:0.1. Therefore, Y=R+G=0.9, C=G+B=0.7, M=R+B=0.4 are obtained.

As a result, when the colors are put in the descending order of the proportions of contributing to the brightness, they are Y (yellow), C (cyan), G (green), M (magenta), R (red), B (blue). Among others, Y (yellow) has the strong influence on the brightness, and C (cyan) has the strong influence next to Y (yellow). Therefore, only Y (yellow) pixels or Y (yellow) and C (cyan) pixels may be extracted to obtain the magnitude of "the number of pixels exceeding the signal values which can be represented (Cn1)" or "the degree of exceeding the signal values which can be represented (Cn2)" based on the extracted pixels.

1.3. Conclusion

The liquid crystal television 1 according to the first embodiment generates image data to be displayed on a display unit 105 which represents a color by using at least four primary colors of RGBW. The liquid crystal television 1 includes the input/output IF unit 101 that obtains the RGB signal which is color signal regarding three primary colors of RGB for image data composed of a plurality of pixels, the changer 205 that changes a value of the obtained color signal regarding the three primary colors (gain setting), and the RGBW converter 202 that converts the changed an RGB signal regarding the three primary colors into an RGBW signal which is a color signal regarding four primary colors. When a predetermined region contains a color saturated pixel, the changer 205 makes the magnitude (gain setting) of the values of the RGB signal smaller, for a group of pixels in the predetermined region. Here, the color saturated pixel is a pixel, of which the RGBW signal converted by the RGBW converter 202 is a color outside of a displayable color gamut of the display unit 105.

With the above described configuration, when the conversion into the color signal regarding four primary colors causes generation of a pixel of color which cannot be represented on the display unit 105, the liquid crystal television 1 decreases the signal values (gain setting) of the color signal for a group of pixels in an image region. That enables the saturation of colors which are represented by the pixels contained in the image region to be suppressed, although the brightness of the pixels decreases. In particular, the liquid crystal television 1 decreases the signal values not only of the pixel, the color of which cannot be represented by the display unit 105, but also the pixels around the pixel. As a result, the liquid crystal television 1 can decrease the brightness of the pixels while retaining the relation of shade between the adjacent pixels, which enables more natural reproduction of the color of the input color signal.

Further, when the number of pixels of which colors indicated by the RGBW signals converted by the RGBW converter 202 are colors outside of the displayable color gamut 301 is larger than a first threshold value, the changer 205 decreases the values of the color signals for the pixels contained in the predetermined region.

With the above described configuration, when there is a pixel which cannot represent a color in the displayable color gamut of the display unit 105, the changer 205 can control to enable the color which cannot be represented in the displayable color gamut to be represented in the displayable color gamut.

Further, when the number of pixels of which colors indicated by the color signals converted by the RGBW converter 202 are colors outside of a displayable color gamut is smaller than a second threshold value which is smaller than the first threshold value, the changer 205 increases the values of the color signal for the pixel contained in the predetermined region. With that configuration, the brightness which is made too dark under the control of the changer 205 can be made brighter.

Further, when the changer 205 changes the values of the color signal for a plurality of pixels, the changer 205 changes the values at a predetermined rate. That enables the values of the color signal for the pixels to be changed stepwise. As a result, the brightness represented by the plurality of pixels can vary smoothly, therefore, uncomfortableness for the viewer can be alleviated.

Further, when the changer 205 changes the values of the color signal for the pixels larger, the changer 205 changes the values larger at a first rate, and when the changer 205 changes the values of the color signal for the pixels smaller, the changer 205 changes the values smaller at a second rate which is different from the first rate.

With that configuration, different rates can be used to change the values of the color signal for the plurality of pixels larger and to change them smaller. As a result, variation in the brightness represented by the plurality of pixels can be adjusted for characteristics of a person's eyesight, so that the brightness represented by the plurality of pixels can be converted into more naturally.

The signal processor 102 may further include a generating unit that generates a control signal regarding the amount of emission of the backlight 1052 in the display unit 105 from the obtained RGB signals for the plurality of pixels. When the changer 205 changes the values of the RGB signal smaller, the generating unit may generate the control signal to increase the amount of emission of the backlight 105 according to the rate of decreasing of the values. As a result, decrease of the signal values by the signal processor 102 can be compensated by increase of the amount of light from the backlight 1052. Therefore, the brightness can be made to appear more natural to the viewer.

Further, the changer 205 may change the values of the RGB signal based on the hue of the RGB signal. With the same number of the pixels having the color signals outside of the displayable color gamut and the same magnitude of the values of the color signals outside of the displayable color gamut, the change result of the changer 205 differs for the hues.

With the described above configuration, when changing the values of the RGB signal, the changer 205 can change the values of the color signal based on the hue of the RGB signal. As a result, color shift in the viewed image data between the color of the corrected color signal and the colors around the color can be decreased.

Further, the changer 205 may increase the rate of decreasing the color signal for the pixel of which the RGB signal having a yellow hue, higher than the rate of decreasing the RGB signal for the pixels having the other color hues. With that configuration, the yellow signal for which the viewer is more sensitive to color shift can be corrected more greatly than the other colors. As a result, the color shift of the viewed image data can be further decreased.

2. Second Embodiment

In the first embodiment, when the RGBW signal contains a color outside of the displayable color gamut, the gain for the entire image region is decreased. However, the image region for which the color saturated pixel is detected and the gain is decreased does not need to be the entire image but only needs to be a region which contains pixels of a color outside of the displayable color gamut. Therefore, in the second embodiment, a configuration of detecting the color saturated pixel and controlling the gain for each of some regions (blocks) of the image region instead of a configuration of detecting the color saturated pixel and decreasing the gain for the entire image region will be described.

Specifically, in the second embodiment, the entire image is divided into a plurality of blocks (for example, regions of 10 in the lateral direction and 6 in the longitudinal direction) and the gain value is controlled based on the RGB signals for the pixels contained in each of the blocks. This control, when a partial region of an image contains a pixel of a color which cannot be displayed, enables the image to be displayed with the original brightness kept for the other regions which do not contain the pixel. The configuration and the operation of the liquid crystal television 1 according to the second embodiment which are different from those of the first embodiment will be described below.

2.1. Signal Processor

Figure 7:
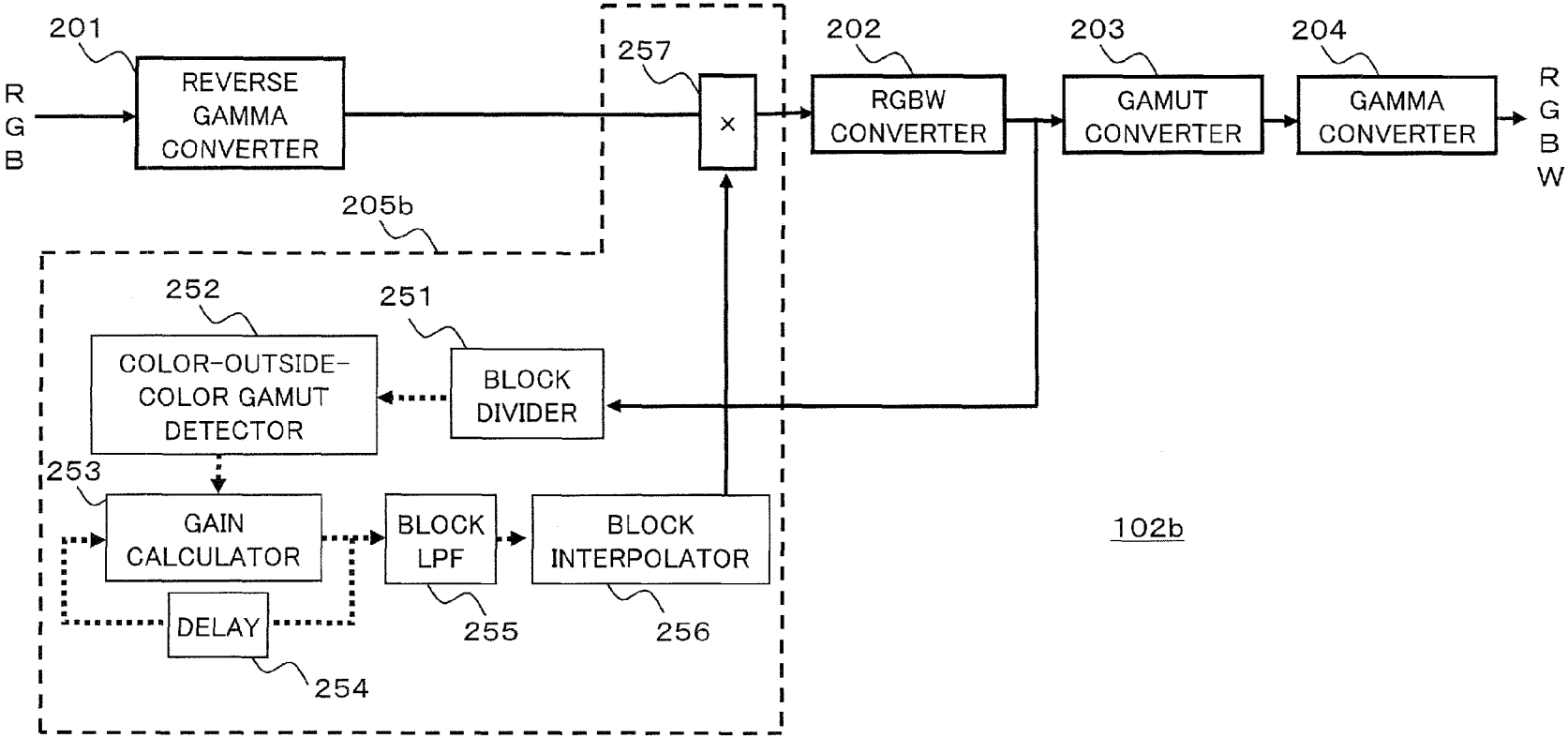
FIG. 7 is a block diagram illustrating a configuration of the signal processor according to a second embodiment.

FIG. 7 is a diagram illustrating an exemplary configuration of the signal processor according to the second embodiment. The signal processor 102*b* illustrated in FIG. 7 is for dividing an image into a plurality of blocks so that local processing can be performed efficiently for each block.

Since the reverse gamma converter 201, the RGBW converter 202, the gamut converter 203, and the gamma converter 204 are the same as those of the first embodiment, the description of them will be omitted here.

In FIG. 7, the solid line indicates the flow of a signal by the pixel unit, and the dashed line indicates the flow of a signal by the block unit.

The changer 205*b* according to the present embodiment includes a block divider 251, a color-outside-color gamut detector 252, a gain calculator 253, a delay unit 254, a block low-pass filter (LPF) 255, a block interpolator 256, and a multiplier 257.

The block divider 251 divides the region of the image which is converted into four colors of RGBW into a plurality of blocks. In the present embodiment, the region of the image is divides the region into 8×6 regions. Meanwhile, the region is divided into, for example, about 3×3 to 32×24 for a 20 inch or more display monitor by taking account of the characteristics of a person's eyesight.

The color-outside-color gamut detector 252 detects information (the number of pixels, degree, and the like) on the color outside of the color gamut which cannot be reproduced by RGBW for each of the blocks resulting from the division.

The gain calculator 253 calculates the brightness gain to be set to the next frame for each block by using the information on the color outside of the color gamut which is detected for each block by the color-outside-color gamut detector 252. The gain calculator 253 refers to the gain for the previous frame which is obtained by the delay circuit 254, and calculates the brightness gain to reduce precipitous variation in terms of time in the calculated gain and to make the gain increase and decrease smoothly.

The gain calculated for each block is processed by the block LPF 255. When gain for a block is extremely different from gain for the surrounding blocks, the gradient of the brightness is remarkable to the eyesight. In order to smooth the gradient of light and darkness with the surrounding blocks to alleviate the remarkableness, the low-pass filtering is performed. The block LPF 255 outputs the gain which is undergone the low-pass filtering to the block interpolator 256.

The block interpolator 256 interpolates the gain calculated by the block unit to the resolution by the pixel unit to calculate the gain by the pixel unit. Then, the block interpolator 256 outputs the gain by the pixel unit to the multiplier 257.

The multiplier 257 multiplies the pixel data of the image obtained from the reverse gamma converter 201 by the gain by the pixel unit obtained from the block interpolator 256.

In that manner, the block information on the previous frame is used to decide the pixel gain for each block of the next frame.

Figure 8:
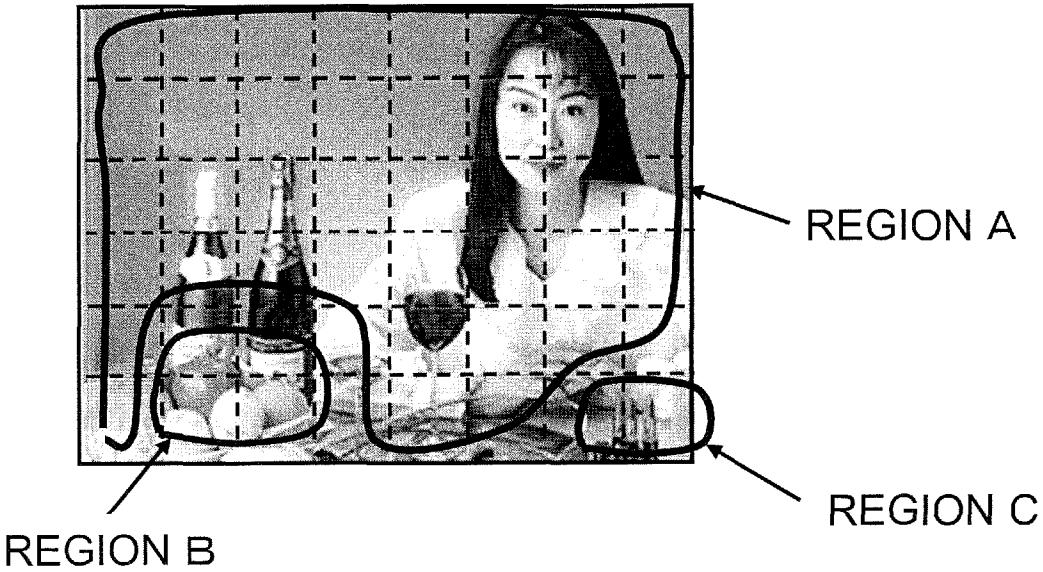
FIG. 8 is a diagram for describing an operation of processing an image area by dividing the image area into blocks according to the second embodiment.

FIG. 8 is a diagram for describing an operation in the case where an image is divided into blocks and processed. In FIG. 8, the image is divided into 8×6 blocks. A region (A) contains an image of a white dress of high brightness. A region (B) contains images of bright yellow lemon, orange, and so on. A region (C) contains a bright and clear image. Since the region (B) and the region (C) contain images containing colors outside of the color gamut, the gain tends to decrease. On the other hand, since the region (A) contains a few colors outside of the color gamut, the gain does not decrease. On the boundary between regions, i.e., between blocks, the gain varies gradually by the effect of the block LPF 255 so that the gradient of the brightness is not visually recognized.

The color-outside-color gamut detector 252 can use various kinds of information described in the first embodiment, i.e., "the count value of pixels which have the signal values exceeding the signal values which can be represented (Cn1)" or "the degree of exceeding the signal values which can be represented (Cn2)". Also, the various algorithms for setting the gain factor described in the first embodiment can be used for the gain factor for each block.

2.1.1. Filtering of Block LPF

Filtering of the block LPF 255 will be described in detail below.

Since the gain factor is decided for each block in the present embodiment, the gains may greatly differ between the adjacent blocks according to the distribution of colors in an image, making the brightness variation visually recognizable. The block LPF 255 is implemented for the purpose of averting such a side effect. The block LPF 255 smoothes variation in the gain factor by averaging the gain factors for adjacent blocks for each 3×3 blocks or 5×5 blocks, for example.

However, with the case of the conventional low-pass filter, the smoothing process produces about the same number of the blocks which have the gain factors increased by the filtering and the blocks which have the gain factors decreased by the filtering. In the present embodiment, increasing of the gain factor means saturation of colors, which lowers the advantage of the idea of the present disclosure. Therefore, in order to solve the problem, the block LPF 255 of the present embodiment uses a low-pass filter of the configuration described below.

First, the configuration of a first example of low-pass filter which has a low ratio of increasing the gain factor and are suitable for the block LPF 255 will be described.

Figure 9A:
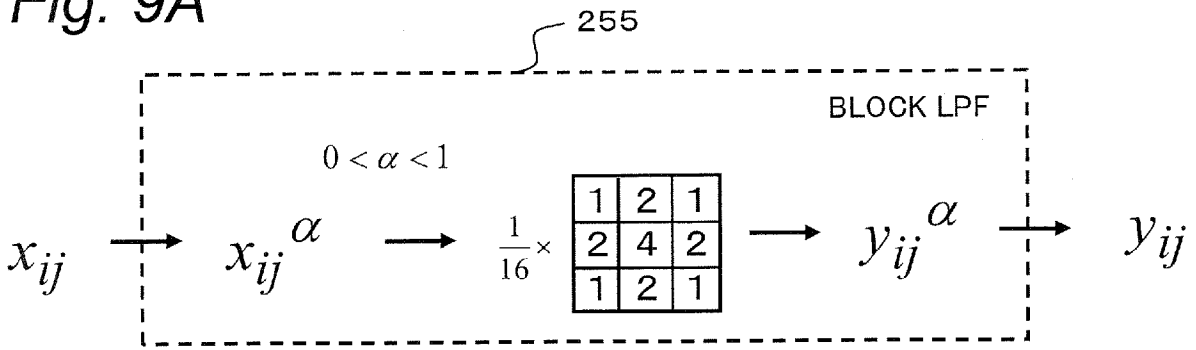
FIG. 9A is a diagram for describing an operation of low-pass filtering in the second embodiment.
Figure 9B:
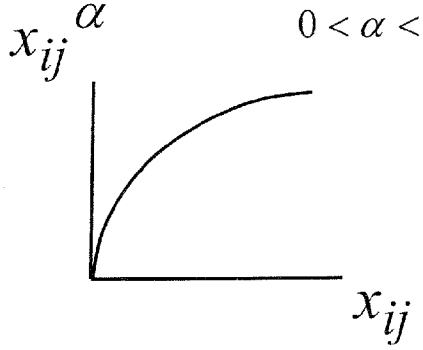
FIG. 9B is a diagram for describing the operation of the low-pass filtering in the second embodiment.
Figure 9C:
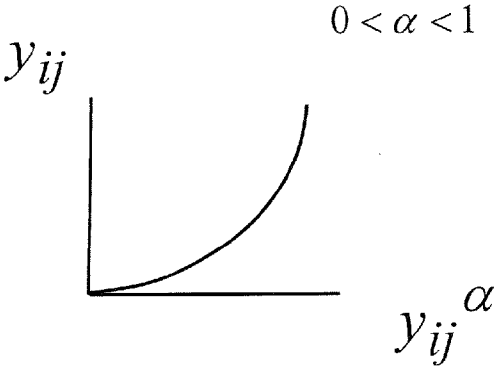
FIG. 9C is a diagram for describing the operation of the low-pass filtering in the second embodiment.

FIGS. 9A to 9C are diagrams for describing operation of the first example of low-pass filter. The first example of low-pass filter performs filtering by using eight blocks around a block of interest. FIG. 9A is a diagram illustrating a processing flow of the first example of low-pass filter. The input gain Xij is a gain factor for the block at the position (i, j) input to the block LPF 255. The output gain Yij is a gain factor for the block at the position (i, j) output from the block LPF 255. $\alpha$ is a positive constant less than 1. $\alpha$ may be set at manufacture or may be set according to the device properties on the display device side.

Step 1: First, the block LPF 255 converts the input gain Xij by using the upward convex conversion characteristic illustrated in FIG. 9B. In that case, Xij is converted by using the previously set a.

Step 2: Next, the block LPF 255 performs weighted addition (averages) on the gain factors for the block at the position (i, j) and its surrounding eight blocks by using each factor in the 3×3 matrix illustrated in FIG. 9A to obtain a provisional output gain factor ($Yij^{\alpha}$). Here, the values of the respective factors in the 3×3 matrix of the block LPF 255 are not limited to the values illustrated in FIG. 9A and may be any values as far as the values can introduce the surrounding influences into the block of interest.

Step 3: Further, the block LPF 255 converts the provisional output gain ($Yij^{\alpha}$) by using the downward convex conversion characteristic illustrated in FIG. 9C to obtain the output gain factor Yij. That conversion characteristic is the inverse function of the function used for the conversion of Xij.

With the above described configuration, when $\alpha=0.25$ and the gain factor Xij for the all blocks is 0.5, for example, the filter input is $0.5^{0.25}=0.84$ but the output Yij is 0.5, which is not changed by the first low-pass filter. However, when the gain factor Xij for the blocks varies for 0 and 1 on a fifty-fifty basis, the average value of the gain factors is unchanged but the output Yij is such a quite small value as 0.063. As such, the first example of low-pass filter is adapted to operate to be more greatly influenced by a small value when the gain factor value varies among the blocks, therefore, the first example of low-pass filter is suitable as the low-pass filter used for the block LPF 255 according to the present embodiment. This is because when a pixel which may be saturated is contained, the gain for the pixel is decreased (the brightness is decreased) to prevent the color saturation more surely.

Next, the configuration of a second example of low-pass filter which is suitable for the block LPF 255 will be described.

Figures 10A, 10B:
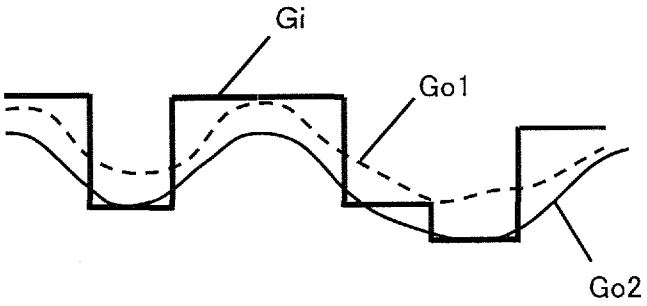
FIG. 10A is a diagram for describing an operation of second low-pass filtering in the second embodiment.
FIG. 10B is a diagram for describing the operation of the second low-pass filtering in the second embodiment.

FIGS. 10A and 10B are diagrams for describing operation of the second example of low-pass filter. FIG. 10A represents input to the second example of low-pass filter. Output from the filter is shown by the next formula in general.

$$y=ka\cdot a+kb\cdot b+kc\cdot c+kd\cdot d+ke\cdot e+kf\cdot f+kg\cdot g+kh\cdot h+ki\cdot i, \quad \text{[Formula 20]}$$

where, ke=1−(ka+kb+kc+kd+kf+kg+kh+ki).

Here, a, b, c, d, e, f, g, h, and i in the formula (20) are respectively the input to the second example of low-pass filter as illustrated in FIG. 10A, i.e., the gain factors for the block of interest and its surrounding blocks. In FIG. 10A, ka, kb, kc, kd, ke, kf, kg, kh, and ki represent the coefficient values of the 3×3 matrix of the low-pass filter.

Here, the formula (20) will be transformed as below to apparently show that the filter is an eight directional filter with the block of interest (the block of the gain factor e) at the center.

$$\begin{aligned} y = {} & ka\cdot(a+e/8)+kb\cdot(b+e/8)+ \\ & kc\cdot(c+e/8)+kd\cdot(d+e/8)+kf\cdot(f+e/8)+ \\ & kg\cdot(g+e/8)+kh\cdot(h+e/8)+ki\cdot(i+e/8)+ \\ & \left(1-\frac{9}{8}\cdot(ka+kb+kc+kd+kf+kg+kh+kj)\right)\cdot e \end{aligned} \quad \text{[Formula 21]}$$

When the coefficients ka, kb, kc . . . are the same, the above formula (21) is equivalent to the above described formula (20). In this example, the coefficients of eight directional low-pass components of the above formula (coefficients except for ke) are adaptively changed.

For example, as for the coefficient in the upper left direction ka, the gain factor for the upper left block a is compared with the gain factor for the block of interest e to change the coefficient in the procedure below.

For example, the coefficients shown in FIG. 9A are used for the gain factors corresponding to the respective coefficients of the 3×3 matrix. In this case, when a<e, ka=1/16 is set. When a>e, ka=0 is set.

That is also the case for the other seven directional coefficients kb, kc, kd, kf, kg, kh, and ki. That is, when b<e, ka=2/16 is set. When b>e, ka=0 is set.

As a result, the gain for the values larger than e is not included in the weighted average and only the values smaller than e are included in the weighted average, therefore, the value of the output gain y does not become larger than e.

For example, when the gain value e for the block of interest is the largest among the 3×3 blocks, the values of the smaller gain factors for the surrounding blocks are taken into account, therefore, the value of the output gain y becomes smaller.

In contrast, when the gain value e for the block of interest is smaller than any of the gain values for the surrounding blocks, ke=1 is set and since the all coefficients for the other bocks become zero, the value of the output gain y does not become larger than e.

Usually, there are both the value(s) larger than e and the value (s) smaller than e as the input to the filter. Even in that case, however, according to the second example of low-pass filter, the larger value(s) is not included in the weighted average and only the smaller value(s) is included in the weighted average. As a result, the low-pass filter which does not output a larger value after the filtering can be implemented.

When the gain value e for the block of interest is the smallest, it seems that the filtering operation is not to be performed, but that is not the case. When the block of interest moves to the next block, the level of the gain value for the block of interest next to the previous block of interest unquestionably decreases under the influence of the gain value for the previous block of interest e, then, a difference between the gain values decreases; therefore, the second example of low-pass filter functions as a low-pass filter to smooth the variation. That operation is illustrated in FIG. 10B. In FIG. 10B, the solid line Gi is the input to the low-pass filter, the dashed line Go1 is the results of processing by a conventional low-pass filter, and the solid line Go2 is the results of processing by the second example of low-pass filter.

Meanwhile, in the above description, the gain value(s) bigger than the gain value for the block of interest is adapted not to include in the weighted average (the coefficient(s)=0 is set). But in practice, it is not required to take such an extreme measures like that and it may only need to decrease the value(s) of the coefficient(s) (for example, decrease the value(s) of the coefficient(s) by half or the like). In short, it may only need to make the coefficient smaller than the original coefficient.

Note that many other low-pass filters which are characterized by having the output gain for the block of interest hardly increase are possible. Any of them can be used to provide the same effect as that of the idea of the present disclosure to reduce the color turbidity of the colors outside of the color gamut.

2.1.2. Processing of Block Interpolator

The detailed operation of the block interpolator 256 will be described with reference to a drawing.

Figure 11:
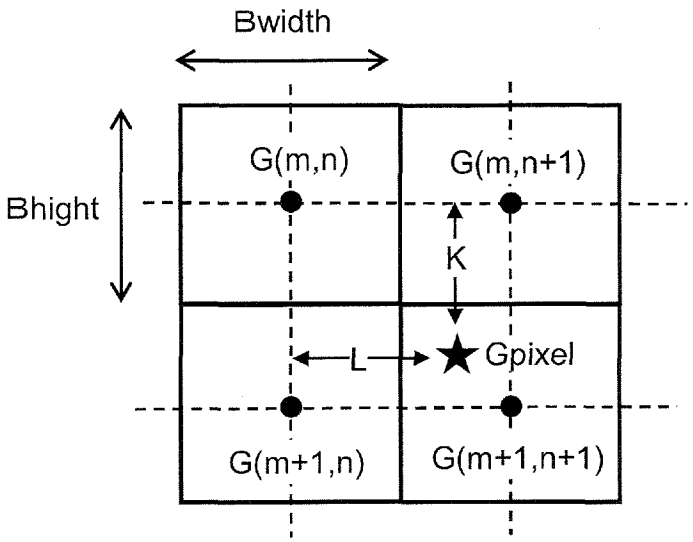
FIG. 11 is a diagram for describing an operation of a block interpolator according to the second embodiment.

FIG. 11 is a diagram for describing the operation of the block interpolator 256. A method of determining gain for the pixels within the region which is defined by the lines connecting the centers of four adjacent blocks will be described below.

It is assumed that The size of one block represented by the number of pixels is (Bwidth, Bheight), and the position of the pixel to be interpolated is at the position apart from the ends of the region defined by the lines connecting the centers of the four blocks by L in the direction x and K in the direction y. In the case where the gain factors for the four blocks are G(m, n), G(m, n+1), G(m+1, n), and G(m+1, n+1), respectively, the gain for the interpolating pixel Gpixel is determined by the following formulas. That is, first, Gup and Gdown are determined by performing linear interpolation based on L in the direction x, then, by using the results, the gain by the pixel unit Gpixel is obtained by performing linear interpolation based on K in the direction y. The same results are obtained by the interpolations performed in the other order.

$$G_{up} = \frac{L \times G(m, n) + (B_{width} - L) \times G(m, n+1)}{B_{width}} \quad \text{[Formula 22]}$$

$$G_{down} = \frac{L \times G(m+1, n) + (B_{width} - L) \times G(m+1, n+1)}{B_{width}} \quad \text{[Formula 23]}$$

$$G_{pixel} = \frac{K \times G_{up} + (B_{height} - K) \times G_{down}}{B_{height}} \quad \text{[Formula 24]}$$

In the above described manner, the gain by the pixel unit can be determined based on the gain by the block unit. Although the one-dimensional interpolation is applied to the direction x or y here, the two-dimensional interpolation may be directly applied. Alternatively, higher order interpolation with many number of taps such as bicubic interpolation may be used. Further, the same effect can also be obtained by a method of up-converting the gain by the block unit into the gain by the pixel unit to smooth the variation without a difference by using the LPF.

2.2. Conclusion

The liquid crystal television 1 according to the second embodiment generates image data to be displayed on a display unit 105 which represents a color by using four primary colors of RGBW. The liquid crystal television 1 includes the input/output IF unit 101 that obtains the RGB signal which is a color signal regarding three primary colors of RGB for image data composed of a plurality of pixels, the changer 205 that changes a value of the obtained RGB signal regarding three primary colors (gain setting), and the RGBW converter 202 that converts the changed RGB signal regarding three primary colors into RGBW signal regarding four primary colors. When a block contains a color saturated pixel, the changer 205 makes the value of the RGB signal smaller for a group of pixels in the block (gain setting).

Further, the liquid crystal television 1 includes a block divider 251 that divides the entire region of the image into a plurality of blocks, and a color-outside-color gamut detector 252 that detects whether there is a pixel of which color indicated by the color signal converted by the RGBW converter 202 is a color outside of the displayable color gamut of the display device 105. The changer 205*b* changes the values of the color signal based on the detection result of the color-outside-color gamut detector 252 for each block.

More specifically, the changer 205 calculates gain values based on the detection result of the color-outside-color gamut detector 252 and changes the values of the color signal based on the calculated gain values, for each block. Even when one block in an image region contains a pixel of a color outside of the displayable color gamut, the above configuration enables the other blocks which do not contain the pixel of a color outside of the displayable color gamut to be displayed with the original brightness kept.

Further, differences of gain factor make the brightness uneven between the adjacent blocks. In order to suppress the unevenness, the gain factors may be interpolated to make the gain factors even for the respective pixels. In addition, too large variation between the gain factors for the respective regions may cause the video to appear unnatural, therefore, smoothing may be performed on the gain factors for the respective regions by using the low-pass filter or the like.

Further, when the backlight 1052 can control the amount of emission for each region, the amount of emission for the region, for which the gain is decreased by the changer 205*b*, may be increased according to the decrease of the gain. That can further improve the reproducibility of colors. For that occasion, by making the region resulting from the division the same as the unit for controlling the amount of emission by the backlight it is easier to cause the gain factor set by the changer 205*b* to influence the backlight control.

Also, after the processing by the gain calculator 253, the block LPF 255 performs signal processing for smoothing the gain values calculated for the respective blocks. The smoothing processing smoothes the gain values so that, out of blocks around the target block of the smoothing processing, a block having the brightness smaller than that of the target block influences stronger than a block having the brightness larger than the brightness of the target block.

With the described above configuration, when the block LPF 255 smoothes the gain values calculated for the respective blocks, the processing can be performed to make the influence of the surrounding dark part stronger. As a result, in displaying the image data, the color reproducibility can be improved and the misadjusted black level can be reduced.

3. Third Embodiment

In the first and second embodiments, the current RGB signal is corrected by using the gain factors calculated from the signal values of the RGBW signal which is processed and generated before in terms of time. That is, the gain for the input RGB signal is corrected by using the feedback control of the RGBW signal.

However, the idea of the present disclosure is not limited to the configuration using the feedback control, and the feedfoward control may be used. Then, in the third embodiment, a configuration of calculating the gain factor by using the feedforward control will be described. Note that the same components as those of the first embodiment are denoted by the same reference letters and the description of them will be omitted.

Figure 12:
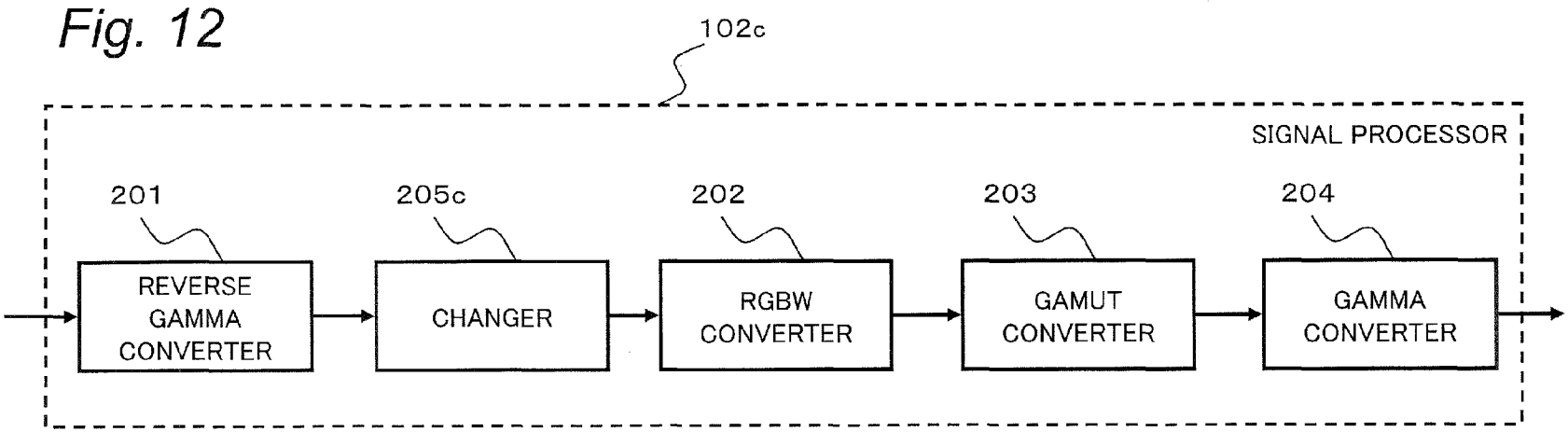
FIG. 12 is a block diagram illustrating a configuration of the signal processor according to a third embodiment.

The signal processor according to the third embodiment will be described with reference to a drawing. FIG. 12 is a diagram illustrating a configuration of the signal processor 102*c* according to the third embodiment.

The signal processor 102*c* according to the third embodiment has the changer 205*c* in place of the changer 205 according to the first embodiment. In the third embodiment, feedback of the RGBW signal is not given from the RGBW converter 202 to the changer 205*c*. The other parts of the configuration are the same as those of the first embodiment.

The operation of the changer 205*c* will be described below in detail. It is assumed that the gain factor set by the changer 205*c* is k. It is also assumed that the signal values of the RGB signal input to the changer 205*c* are (R0, G0, and B0).

The changer 205*c* decides a gain factor for the RGB signal input from the reverse gamma converter 201 based on the conversion characteristic of the RGB signal in the RGBW converter 202, and changes the level of the RGB signal by using the gain. Here, it is assumed that the conversion characteristic in the RGBW converter 202 is defined by the operation of the RGBW converter 202 and the formula (6) to the formula (8) of the first embodiment. The operation of the changer 205*c* differs according to the converting processing of the RGBW converter 202.

The changer 205*c* multiplies the signal values composing the input RGB signal by the gain factor k. Here, the setting method of the gain factor k will be described.

First, the changer 205*c* is input the RGB signal (R0, G0, and B0) which has undergone the reverse gamma conversion from the reverse gamma converter 201.

The changer 205*c* recognizes the conversion characteristic in the RGBW converter 202, i.e., the conversion characteristic which is defined based on the formula (6) to the formula (8). Therefore, according to the formula (6), relation of the following formulas is established for the signal value corresponding to the R primary color point.

$$R0'=k\times R0 \quad \text{[Formula 25]}$$

$$R1=2\times R0' \quad \text{[Formula 26]}$$

Further, according to the formulas (7) and (8), when the signal value which can be represented on the liquid crystal panel 1501 is from 0 to 255, the changer 205*c* needs to satisfy the following formula not to saturate the color signal.

$$R1-W2\leq 255\rightarrow 2\times k\times R0-\min(R1,G1,B1,255)\leq 255\rightarrow 2\times k\times R0-2\times k\times\min(R0,G0,B0,255)\leq 255\rightarrow 2\times k\times\{R0-\min(R0,G0,B0,255)\}\leq 255\rightarrow k\leq 255/[2\times\{R0-\min(R0,G0,B0,255)\}] \quad \text{[Formula 27]}$$

Similarly, the following formulas are established for the G primary color point and the B primary color point.

$$k\leq 255/[2\times\{G0-\min(R0,G0,B0,255)\}] \quad \text{[Formula 28]}$$

$$k\leq 255/[2\times\{B0-\min(R0,G0,B0,255)\}] \quad \text{[Formula 29]}$$

By taking account of the above formulas, the changer 205*c* sets the gain factor k in one picture to satisfy the following formula.

$$k\leq 255/[2\times\{\max(R0,G0,B0)-\min(R0,G0,B0,255)\}] \quad \text{[Formula 30]}$$

By setting the gain factor k according to the formula (30), the changer 205*c* can set the gain factor k so that the color conversion from the RGB signal into the RGBW signal does not cause the color saturation, i.e., does not cause the conversion into a color outside of the displayable color gamut 301. That is, the changer 250*c* can suppress the color saturation by using the feedfoward control.

Also in the present embodiment, the region of the entire image may be divided into a plurality of blocks so that the gain factor is controlled to prevent the color saturation for each block as in the second embodiment.

As described above, the liquid crystal television 1 according to the third embodiment generates image data to be displayed on a display device which represents a color by using four primary colors of RGBW. The liquid crystal television 1 includes the input/output IF unit 101 that obtains an RGB signal which is a color signal regarding three primary colors of RGB for image data composed of a plurality of pixels, the changer 205 that changes a value of the RGB signal which is the obtained color signal regarding three primary colors, and the RGBW converter 202 which converts the color signal regarding three primary colors into an RGBW signal regarding four primary colors based on a predetermined conversion characteristic. The changer 205 makes the magnitude of the values of the RGB signals for pixels contained in a predetermined region (a part of or the entire of an image region) smaller based on the conversion characteristic of the RGBW converter 202 to prevent colors indicated by the converted RGBW signals from being colors outside of a displayable color gamut of the display unit 105 in the predetermined region (the entire image, a block region, or the like).

With the above described configuration, the liquid crystal television 1 can calculate the gain values for preventing the saturation of signals based on the conversion characteristic of the RGBW converter 202 before actually converting the RGB signal into the RGBW signal (feedforward control). Further, according to the calculation result, the liquid crystal television 1 can collectively change the signal values for the color signals for a plurality of pixels obtained by the input-output IF 101. Therefore, the liquid crystal television 1 can collectively change the signal values for the RGB signals not only for the pixels which cannot represent the color in the displayable color gamut of the display unit 105 but also for the pixels around the pixels which cannot represent the color in the displayable color gamut of the display unit 105. That is, by changing the brightness of the input RGB signals by the feedforward control, the brightness represented by the RGBW signals, which are converted from the RGB signals, decreases, but the liquid crystal television 1 can suppress the saturation of the color represented by the RGBW signals. Therefore, the color reproducibility of input color signals can be improved.

Here, with the above described configuration, the liquid crystal television 1 suppresses the saturation of signals after the color conversion by previously setting the gain for the RGB signals so that the colors are not saturated, based on the conversion characteristic of the RGBW converter 202. However, a method for suppressing saturation of signals after the color conversion is not limited to the above method, and another method can be used. For example, the changer 205*c* may predict the RGBW signals resulting from the conversion by the RGBW converter 202 from the input RGB signals based on the conversion characteristic of the RGBW converter 202. The changer 205*c* may, by using the predicted RGBW signals, according to the method described in the first embodiment, calculate "the number of pixels which have the signal values exceeding the signal values which can be represented (Cn1)" or "the magnitude of the degree of exceeding the signal values which can be represented (Cn2)". Further, the changer 205*c* may set the gain for the RGB signals based on the calculated "number of pixels which have the signal values exceeding the signal values which can be represented (Cn1)" or the calculated "magnitude of the degree of exceeding the signal values which can be represented (Cn2)". That configuration can also provide the similar effect.

4. Other Embodiments

Some embodiments are described above, although, the idea of the present disclosure is not limited to the above embodiments.

(1) The derivations of gain factors in the above described embodiments are examples and the derivation is not limited to them. The changers 205, . . . may set the gain factor not to saturate the color signals according to the characteristics of the RGBW converter 202. For some characteristics of the RGBW converter 202, the gain factor cannot analytically be determined (in such cases as non-linear converting processing). Even in those cases, however, some publicly known numerical analysis methods like the Newton's method may enable setting of the gain factor.

Note that, when the calculated gain factor is used as it is to influence the processing, the gain factor may significantly vary in the direction of time axis for some video properties, causing flickers in the video. Therefore, the embodiment may be configured to use the IIR filter or the like to prevent the gain factor from varying significantly as described above. In short, the filtering may be performed to make the gain factor smoothly vary in terms of time.

(2) When the input video is a still picture, the embodiment may be adapted to apply the gain factor adjusted for the still picture at the moment when the still picture is switched. That approach can suppress the occurrence of a phenomenon in which the video gradually darkens when the video switches. Also the first embodiment may be adapted to have a feedback loop cycled for a plurality of times before outputting the switched video, wait for convergence of the gain factors to a certain value, and then output the video. The similar effect can also be provided in that case.

(3) Although the above described embodiments are adapted to decrease the magnitude of the signal values of the all signals of the RGB signals for the pixels in the region in which a saturated pixel is detected, the embodiments may be adapted to decrease the signal value of at least any one primary color among R (red), G (green), and B (blue).

(4) The above described embodiments may be adapted to cause the display unit 105 to change the intensity of irradiation light to be irradiated according to the correction operation performed by the changers 205, 205*b*, and 205*c*. For example, when the changers 205, make correction to decrease the signal values, the display unit 105 is controlled to increase the intensity of irradiation light. With that operation, the embodiments can brighten up the video which has darkened under the correction operation performed by the changers 205, Conversely, when the changer 205 and the changer 205*c* make correction to increase the signal values, the display unit 105 may be controlled to decrease the intensity of irradiation light. With that operation, the embodiments can reduce the power consumption.

(5) The changers 205 and 205*c* may use different rates of change between the case in which changing the values of the color signal larger and the case in which changing the values of the color signal smaller. That is, when changing the values of the color signal larger, the changers 205, 205*c* may change the values larger at a first rate, and when changing the values of the color signal smaller, the changers 205, 205*c* may change the values smaller at a second rate which is different from the first rate. As a result of using different rates in changing the values of the color signal larger and in changing the values of the color signal smaller like that, changes in the brightness represented by the pixels can be adjusted for characteristics of a person's eyesight, therefore, the brightness conversion which may appear more natural to the viewer can be achieved.

(6) The above described embodiments decrease the brightness of a color represented according to the RGB signal by changing the gain setting for the RGB signal smaller in order to suppress color saturation. However, the method of suppressing color saturation is not limited to the above described method. For example, the changer 205 may have a lookup table (LUT) for converting a color outside of a displayable color gamut into a color within the displayable color gamut to use the lookup table in converting the color outside of the displayable color gamut into a color within the displayable color gamut.

(7) The color signal processing algorithms in the present disclosure can be circulated on recording media such as a CD-ROM (Compact Disc-Read Only Memory) or on a communication network such as the Internet.

(8) The signal processors 102, 102*b*, and 102*c* in the above described embodiments may be implemented by integrated circuits. As an integrated circuit, an LSI as a typical integrated circuit may be used. In that case, the LSI may be implemented as one chip or may be implemented as a plurality of chips. For example, functional blocks except for a memory may be composed of one-chip LSI. Meanwhile, the integrated circuit is not limited to the LSI and may be called IC, system LSI, super LSI, or ultra LSI according to the integration density.

The integrated circuit may be implemented by a dedicated circuit or a general purpose processor, or may be implemented by an FPGA (Field Programmable Gate Array) which is programmable or a reconfigurable processor which can reconfigure connection and setting of the circuit cells inside the LSI.

Furthermore, when a new technology of integration circuit implementation is developed to replace the LSI as advancement of the semiconductor technology or derivation from the semiconductor technology, the new technology may be used in implementing the above described functions. For example, biotechnology may be used.

Further, as for the integrated circuit implementation, out of the respective functional blocks, a unit for storing data is exclusively made into another component instead of integrated into one chip.

(9) The idea of the above described embodiments is not limited to a display made of a liquid crystal panel, a plasma display panel (PDP), or the like, but may be widely applied to the display devices which can represent colors by using at least four primary color points.

INDUSTRIAL APPLICABILITY

The color signal processing device according to the present disclosure can perform color conversion processing on video signals for the user to comfortably watch the video, and therefore, the color signal processing device can be applied to a liquid crystal television and the like.

What is claimed is:

1. A color signal processing device for generating image data to be displayed on a display device which represents a color by using at least four primary colors, comprising:

a processor; and a non-transitory memory having stored thereon executable instructions, which when executed, cause the processor to operate as:

an obtainer that obtains a color signal regarding three primary colors for image data composed of a plurality of pixels;

a changer that changes a value of the obtained color signal regarding the three primary colors based on the hue of the color indicated by the color signal; and a converter that converts the changed color signal regarding the three primary colors into a color signal regarding four primary colors, wherein the value of the obtained color signal in the changer is changed by performing a feedback control in which the converter feeds back the converted color signal to the changer, the changer detects whether a pixel having a color indicated by the converted color signal fed back from the converter is a color saturated pixel, the changer counts a number of the detected color saturated pixels, the changer weighs the counted number for a pixel of the color signal indicating a yellow hue with a weight for the yellow hue which is larger than each weight for other color hues, so as to increase a rate of decreasing a color signal for a pixel of which the color signal indicates a yellow hue higher than a rate of decreasing color signals for pixel of which the color signals indicate other color hues, the changer compares the counted number with a first threshold value and a second threshold value, the first threshold value being an integral number of 1 or more and the second threshold value being smaller than the first threshold value, when the counted number is larger than the first threshold value, the changer decreases the value of the obtained color signal for the pixels contained in a predetermined region, when the counted number is smaller than the second threshold value, the changer increases the value of the obtained color signal for the pixels contained in the predetermined region, and the color saturated pixel is a pixel having a color outside of a displayable color gamut of the display device.

2. The color signal processing device according to claim 1, wherein when the changer changes the value of the color signal, the changer changes the value at a predetermined rate.

3. The color signal processing device according to claim 2, wherein when the changer increases the value of the color signal, the changer increases the value at a first rate, and when the changer decreases the value of the color signal, the changer decreases the value at a second rate which is different from the first rate.

4. The color signal processing device according to claim 1, wherein the executable instructions, when executed, cause the processor to further operate as a generator that generates a control signal regarding the amount of emission of a backlight in the display device from the obtained color signal for the plurality of pixels, and when the changer decreases the value of the color signal, the generator controls the control signal to increase the amount of emission of the backlight.

5. The color signal processing device according to claim 1, wherein the executable instructions, when executed, cause the processor to further operate as:

a block divider that divides the entire region of the image into a plurality of blocks; and a detector that detects whether there is a pixel of which a color signal converted by the converter is a signal indicating a color outside of the displayable color gamut of the display device in each block, and the changer changes the value of the color signal based on the detection result of the detector for each block.

6. The color signal processing device according to claim 5, wherein the changer calculates a gain value based on the detection result of the detector and changes the value of the color signal based on the calculated gain value for each block.

7. The color signal processing device according to claim 6, wherein the changer performs smoothing processing for smoothing the gain values calculated for the respective blocks among the blocks, and the smoothing processing smoothes the gain values so that, out of blocks around a target block of the smoothing processing, a block having a brightness smaller than a brightness of the target block influences stronger than a block having a brightness larger than the brightness of the target block.

8. The color signal processing device according to claim 1, wherein the changer calculates a gain value based on the converted color signal fed back from the converter, and changed the value of the color signal based on the calculated gain value.

* * * * *